US011028672B2

(12) United States Patent
Jeanson

(10) Patent No.: US 11,028,672 B2
(45) Date of Patent: Jun. 8, 2021

(54) WIRELINE SERVICES SYSTEM

(71) Applicant: Schlumberger Technology Corporation, Sugar Land, TX (US)

(72) Inventor: Eric Jeanson, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 8 days.

(21) Appl. No.: 16/309,930

(22) PCT Filed: Jun. 30, 2016

(86) PCT No.: PCT/US2016/040226
§ 371 (c)(1),
(2) Date: Dec. 14, 2018

(87) PCT Pub. No.: WO2018/004575
PCT Pub. Date: Jan. 4, 2018

(65) Prior Publication Data
US 2019/0145227 A1 May 16, 2019

(51) Int. Cl.

| | |
|---|---|
| ***E21B 41/00*** | (2006.01) |
| ***E21B 47/12*** | (2012.01) |
| ***E21B 44/00*** | (2006.01) |
| ***E21B 21/06*** | (2006.01) |
| ***E21B 19/00*** | (2006.01) |

(52) U.S. Cl.
CPC ..... *E21B 41/0092* (2013.01); *E21B 19/008* (2013.01); *E21B 21/06* (2013.01); *E21B 44/00* (2013.01); *E21B 47/12* (2013.01)

(58) Field of Classification Search
CPC .... E21B 19/008; E21B 21/06; E21B 41/0092; E21B 44/00; E21B 47/12
See application file for complete search history.

(56) References Cited

U.S. PATENT DOCUMENTS

| | | | |
|---|---|---|---|
| 2006/0089763 | A1 | 4/2006 | Barrett et al. |
| 2006/0089800 | A1 | 4/2006 | Svendsen et al. |
| 2008/0144656 | A1 | 6/2008 | Frishberg et al. |
| 2008/0263469 | A1 | 10/2008 | Nasle et al. |

(Continued)

FOREIGN PATENT DOCUMENTS

| | | | |
|---|---|---|---|
| WO | 2014/014438 | A1 | 1/2014 |
| WO | 2014/077804 | A1 | 5/2014 |

(Continued)

OTHER PUBLICATIONS

Extended Search Report for the European patent application 16907538.9 dated Apr. 21, 2020.

(Continued)

*Primary Examiner* — Caroline N Butcher

(57) ABSTRACT

A wireline services system server can include a processor; memory operatively coupled to the processor; a network interface; at least one wireline services equipment interface; and processor-executable instructions stored in the memory executable to instruct the wireline services system server to operate in a user interactive mode via receipt of client communications via a network connection at the network interface; operate in an automated mode; and operate in a safe mode responsive to interruption of a network connection at the network interface.

20 Claims, 15 Drawing Sheets

(56) References Cited

U.S. PATENT DOCUMENTS

| | | | | |
|---|---|---|---|---|
| 2010/0250023 | A1* | 9/2010 | Gudat | G05D 1/0022 701/2 |
| 2012/0274664 | A1 | 11/2012 | Fagnou | |
| 2013/0076525 | A1* | 3/2013 | Vu | E21B 47/00 340/853.1 |
| 2015/0330201 | A1 | 11/2015 | Dashevskiy | |
| 2015/0362623 | A1 | 12/2015 | Miotti et al. | |
| 2016/0033248 | A1 | 2/2016 | Mace et al. | |
| 2018/0051540 | A1* | 2/2018 | Castillo | E21B 47/007 |

FOREIGN PATENT DOCUMENTS

| | | | | |
|---|---|---|---|---|
| WO | WO-2014077804 | A1 * | 5/2014 | G06F 16/22 |
| WO | 2015/168417 | A1 | 11/2015 | |

OTHER PUBLICATIONS

International Preliminary Report on Patentability for the equivalent International patent application PCT/US2016/040226 dated Jan. 10, 2019.

International Search Report and Written Opinion for the equivalent International patent application PCT/US2016/040226 dated Dec. 19, 2017.

Partial Search Report for the European patent application 16907538.9 dated Jan. 7, 2020.

Communication pursuant to Article 94(3) EPC dated Feb. 22, 2021 in counterpart European Application No. 16907538.9, 4 pages.

* cited by examiner

WIRELINE SERVICES SYSTEM

BACKGROUND

A rig may be a system of components that can be operated to form a bore in a geologic environment, to transport equipment into and out of a bore in a geologic environment, etc. As an example, a rig may be a system that can be used to drill a wellbore and to acquire information about a geologic environment, drilling, etc. As an example, a rig can include components such as one or more of a mud tank, a mud pump, a derrick or a mast, drawworks, a rotary table or a top drive, a drillstring, power generation equipment and auxiliary equipment. As an example, an offshore rig may include one or more of such components, which may be on a vessel or a drilling platform.

Wireline services can include deployment of one or more tools in a bore in a geologic environment, for example, as drilled via a rig. Wireline services can include acquiring petrophysical measurements that can, for example, help to determine petrophysical properties of a reservoir, its fluid contents, etc. Some examples of wireline services tools include a lithology scanner spectrometer (e.g., to measure elements and quantitatively determine total organic carbon (TOC) in a wide variety of formations), a dielectric scanner (e.g., to measure water volume and rock textural information to determine hydrocarbon volume, whether in carbonates, shaly or laminated sands, or heavy oil reservoirs), a magnetic resonance scanner (e.g., to acquire NMR measurement of porosity, permeability, and fluid volumes), an Rt scanner (e.g., to acquire resistivity measurements germane to formation dip, anisotropy, beds, etc.), a sonic scanner acoustic scanning platform (e.g., to understand a reservoir stress regime and anisotropy through 3D acoustic measurements made axially, azimuthally, and/or radially), an analysis behind casing tool, (e.g., well log data—including the collection of fluid samples—in cased holes to find bypassed pay, etc.), etc.

Wireline services can include conveyance of equipment in a bore of a geologic environment. Conveyance can be performed by a crew in a hands-on manner to account for bore characteristics, particularly bore geometries. As an example, complex well geometries and extended bore depths can present challenges for conveyance by wireline services crew. As an example, deep and highly deviated bores can pose safety and logistics concerns. Where challenges exist, delays may be incurred, particularly as to decisions as to how to proceed. Expertise can vary from crew to crew, which can result in variations in setup of wireline services equipment, operation thereof, and associated risks to people and equipment.

SUMMARY

In accordance with some embodiments, a wireline services system server includes a processor; memory operatively coupled to the processor; a network interface; at least one wireline services equipment interface; and processor-executable instructions stored in the memory executable to instruct the wireline services system server to operate in a user interactive mode via receipt of client communications via a network connection at the network interface; operate in an automated mode; and operate in a safe mode responsive to interruption of a network connection at the network interface.

In some embodiments, a wireline services system server includes processor-executable instructions stored in the memory executable to instruct the wireline services system server to build a model of a wireline services equipment set up at a wellsite. In some embodiments, the automated mode operates at least in part on the model. In some embodiments, the safe mode operates at least in part on the model.

In some embodiments, a wireline services system server includes an automated mode that operates to transmit information via a network connection at a network interface. In some embodiments, a wireline services system server includes processor-executable instructions stored in memory executable to instruct the wireline services system server to transition from an automated mode to a safe mode responsive to interruption of a network connection at a network interface. In some embodiments, a network connection includes a satellite network connection where interruption of the network connection spans a period of time greater than approximately one minute prior to the transition.

In some embodiments, a wireline services system server includes processor-executable instructions stored in memory executable to instruct the wireline services system server to operate an orchestration tier and an automation tier. In some embodiments, an orchestration tier includes an application programming interface (API) for a user interactive mode where an automation tier includes an interface that receives information via the orchestration tier. In some embodiments, for a safe mode, an automation tier operates independent of information of an orchestration tier. In some embodiments, for an automated mode, an orchestration tier operates independent of information received via a network interface.

In some embodiments, a wireline services system server includes processor-executable instructions stored in memory executable to instruct the wireline services system server to operate a winch that conveys a wireline tool via a cable. In some embodiments, operation of a winch is according to logic specified in a domain specific language (DSL). In some embodiments, operation of a winch is based at least in part on depth information. In some embodiments, operation of a winch is based at least in part on a speed limit for conveyance.

In accordance with some embodiments, a method includes enabling operational modes of a wireline services system operatively coupled to wireline services equipment at a wellsite where the operational modes include a user interactive mode and an automated mode; receiving a communication via a network connection at a network interface of the wireline services system at the wellsite; operating the wireline services system equipment based at least in part on the communication; and transitioning the wireline services system to the automated mode.

In some embodiments, an aspect of a method includes operational modes that include a safe mode and a method includes detecting interruption of a network connection at a network interface and transitioning a wireline services system to the safe mode.

In some embodiments, an aspect of a method includes an automated mode that operates a wireline services system according to a model of at least a portion of wireline services equipment at a wellsite.

In accordance with some embodiments, one or more computer-readable storage media include computer-executable instructions executable to instruct a computer to: enable operational modes of a wireline services system operatively coupled to wireline services equipment at a wellsite where the operational modes include a user interactive mode and an automated mode; receive a communication via a network connection at a network interface of the wireline services system at the wellsite; operate the wireline services system equipment based at least in part on the communication; and transition the wireline services system to the automated mode.

In some embodiments, operational modes include a safe mode and instructions include instructions to detect interruption of a network connection at a network interface and to transition a wireline services system to the safe mode.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Figure 1:
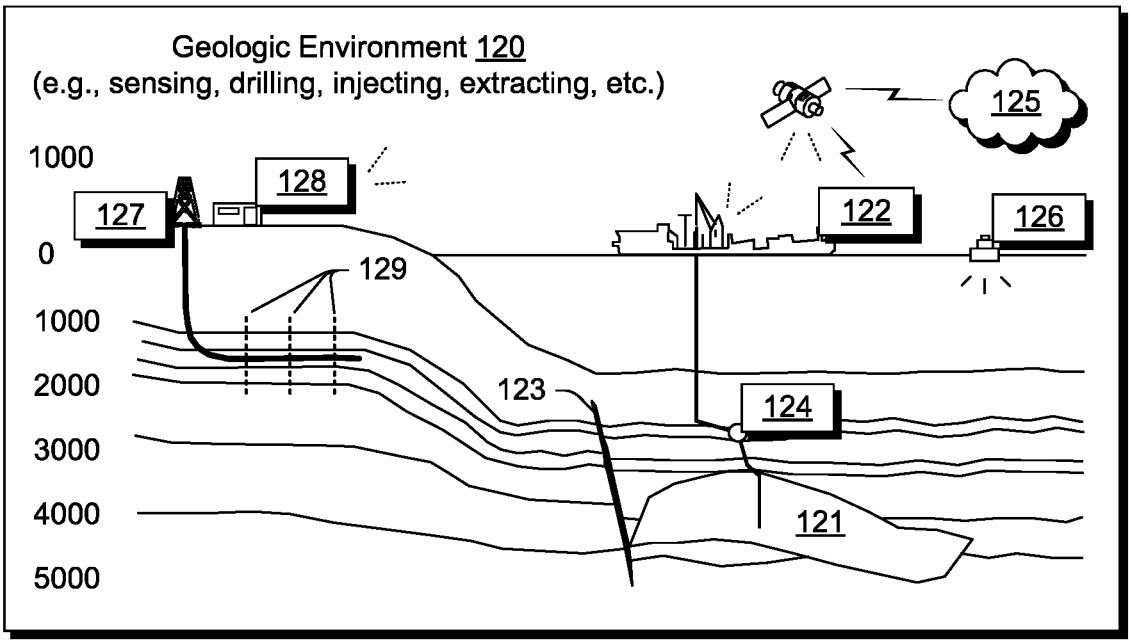
FIG. 1 illustrates examples of equipment in a geologic environment.
Figure 1:
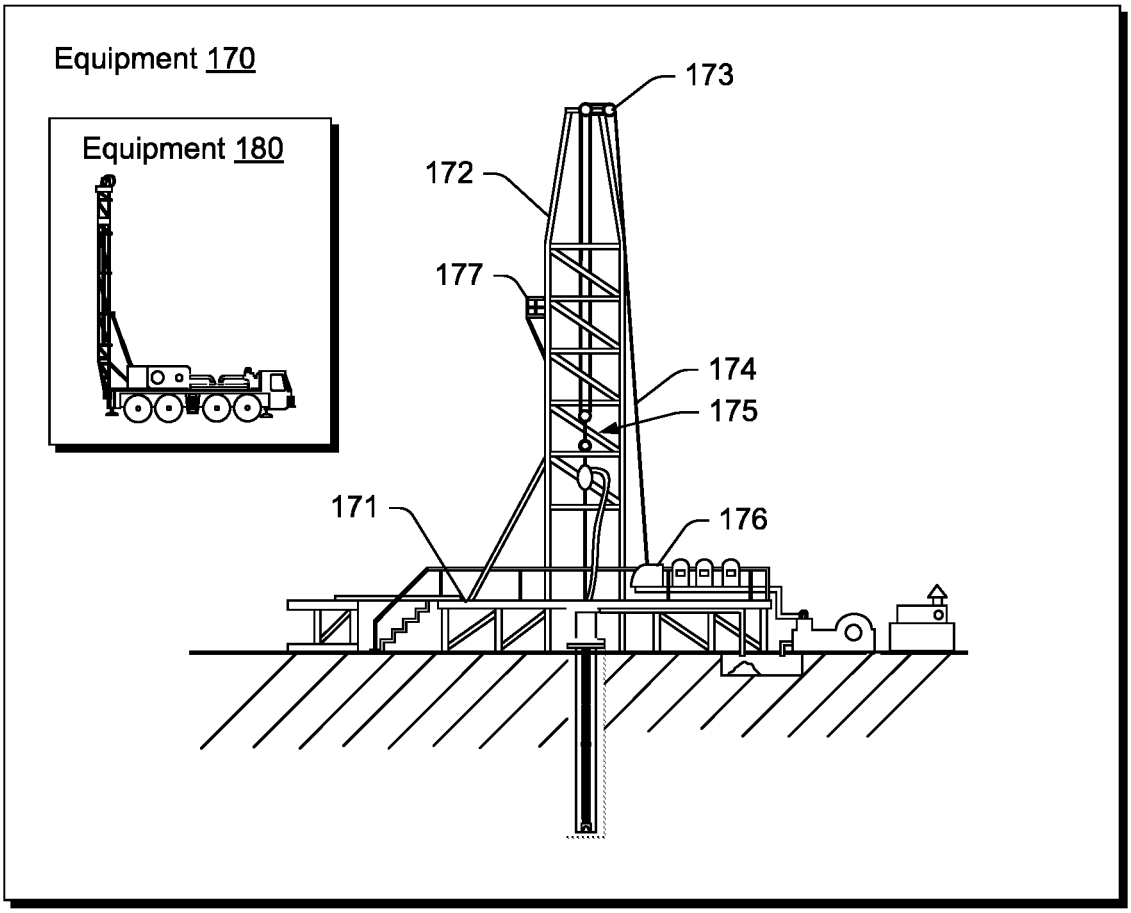

FIG. 1 shows an example of a geologic environment 120. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with any of a variety of sensors, detectors, actuators, etc. For example, equipment 122 may include communication circuitry to receive and to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more pieces of equipment may provide for measurement, collection, communication, storage, analysis, etc. of data (e.g., for one or more produced resources, etc.). As an example, one or more satellites may be provided for purposes of communications, data acquisition, geolocation, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

FIG. 1 also shows the geologic environment 120 as optionally including equipment 127 and 128 associated with a well that includes a substantially horizontal portion that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, injection, production, etc. As an example, the equipment 127 and/or 128 may provide for measurement, collection, communication, storage, analysis, etc. of data such as, for example, production data (e.g., for one or more produced resources). As an example, one or more satellites may be provided for purposes of communications, data acquisition, etc.

FIG. 1 also shows an example of equipment 170 and an example of equipment 180. Such equipment, which may be systems of components, may be suitable for use in the geologic environment 120. While the equipment 170 and 180 are illustrated as land-based, various components may be suitable for use in an offshore system.

The equipment 170 includes a platform 171, a derrick 172, a crown block 173, a line 174, a traveling block assembly 175, drawworks 176 and a landing 177 (e.g., a monkeyboard). As an example, the line 174 may be controlled at least in part via the drawworks 176 such that the traveling block assembly 175 travels in a vertical direction with respect to the platform 171. For example, by drawing the line 174 in, the drawworks 176 may cause the line 174 to run through the crown block 173 and lift the traveling block assembly 175 skyward away from the platform 171; whereas, by allowing the line 174 out, the drawworks 176 may cause the line 174 to run through the crown block 173 and lower the traveling block assembly 175 toward the platform 171. Where the traveling block assembly 175 carries pipe (e.g., casing, etc.), tracking of movement of the traveling block 175 may provide an indication as to how much pipe has been deployed.

A derrick can be a structure used to support a crown block and a traveling block operatively coupled to the crown block at least in part via line. A derrick may be pyramidal in shape and offer a suitable strength-to-weight ratio. A derrick may be movable as a unit or in a piece by piece manner (e.g., to be assembled and disassembled).

As an example, drawworks may include a spool, brakes, a power source and assorted auxiliary devices. Drawworks may controllably reel out and reel in line. Line may be reeled over a crown block and coupled to a traveling block to gain mechanical advantage in a "block and tackle" or "pulley" fashion. Reeling out and in of line can cause a traveling block (e.g., and whatever may be hanging underneath it), to be lowered into or raised out of a bore. Reeling out of line may be powered by gravity and reeling in by a motor, an engine, etc. (e.g., an electric motor, a diesel engine, etc.).

As an example, a crown block can include a set of pulleys (e.g., sheaves) that can be located at or near a top of a derrick or a mast, over which line is threaded. A traveling block can include a set of sheaves that can be moved up and down in a derrick or a mast via line threaded in the set of sheaves of the traveling block and in the set of sheaves of a crown block. A crown block, a traveling block and a line can form a pulley system of a derrick or a mast, which may enable handling of heavy loads (e.g., drillstring, pipe, casing, liners, etc.) to be lifted out of or lowered into a bore. As an example, line may be about a centimeter to about five centimeters in diameter as, for example, steel cable. Through use of a set of sheaves, such line may carry loads heavier than the line could support as a single strand.

As an example, a derrick person may be a rig crew member that works on a platform attached to a derrick or a mast. A derrick can include a landing on which a derrick person may stand. As an example, such a landing may be about 10 meters or more above a rig floor. In an operation referred to as trip out of the hole (TOH), a derrick person may wear a safety harness that enables leaning out from the work landing (e.g., monkeyboard) to reach pipe in located at or near the center of a derrick or a mast and to throw a line around the pipe and pull it back into its storage location (e.g., fingerboards), for example, until it a time at which it may be desirable to run the pipe back into the bore. As an example, a rig may include automated pipe-handling equipment such that the derrick person controls the machinery rather than physically handling the pipe.

As an example, a trip may refer to the act of pulling equipment from a bore and/or placing equipment in a bore. As an example, equipment may include a drillstring that can be pulled out of the hole and/or place or replaced in the hole. As an example, a pipe trip may be performed where a drill bit has dulled or has otherwise ceased to drill efficiently and is to be replaced.

Figure 2:
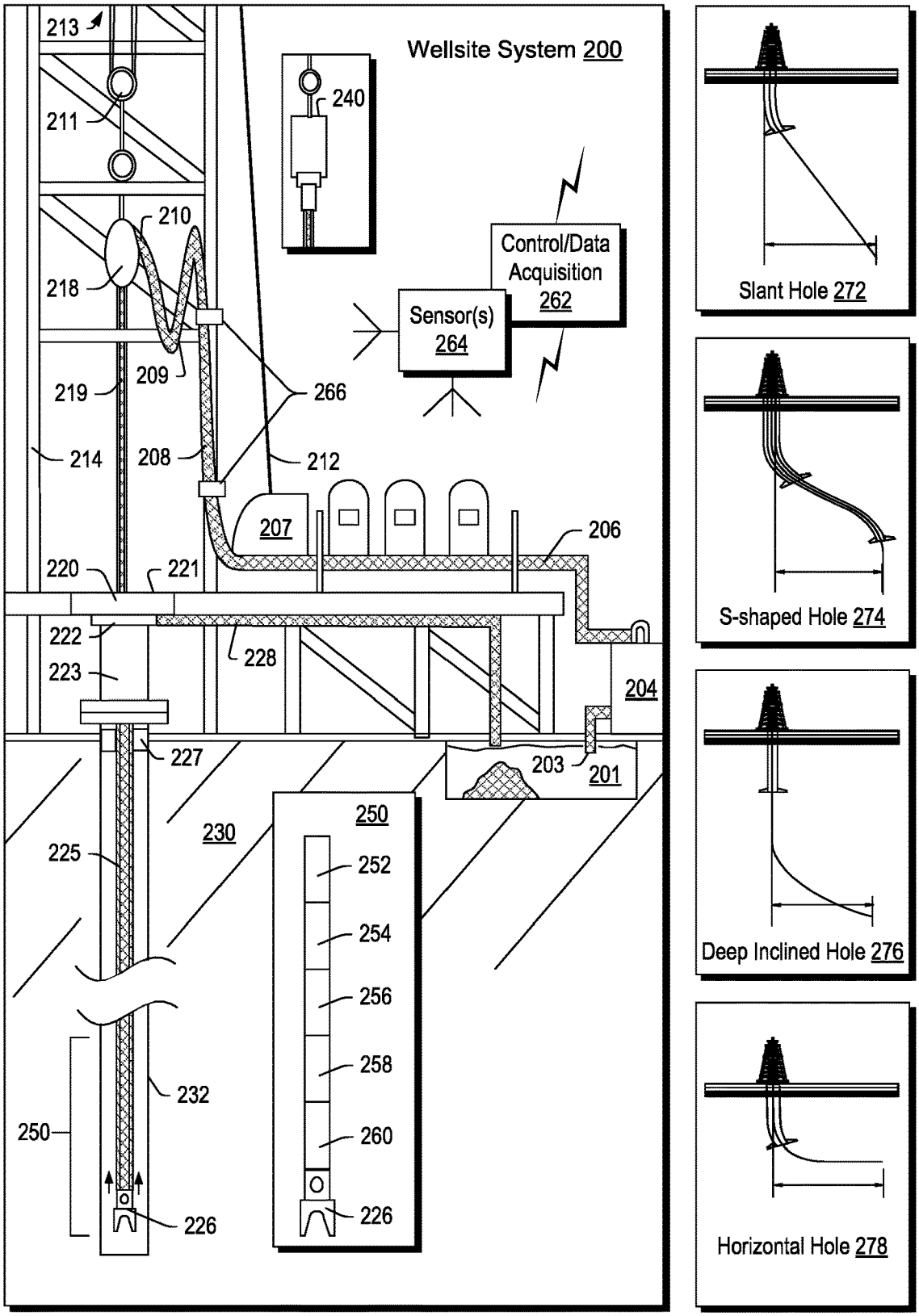
FIG. 2 illustrates an example of a system and examples of types of holes.

FIG. 2 shows an example of a wellsite system 200 (e.g., at a wellsite that may be onshore or offshore). As shown, the wellsite system 200 can include a mud tank 201 for holding mud and other material, a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212 (see, e.g., the crown block 173 of FIG. 1), a derrick 214 (see, e.g., the derrick 172 of FIG. 1), a kelly 218 or a top drive 240, a kelly drive bushing 219, a rotary table 220, a drill floor 221, a bell nipple 222, one or more blowout preventers or protectors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use directional drilling.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 can provide for operation of the drillstring 225 and other operations. As shown, the wellsite system 200 includes the platform 211 and the derrick 214 positioned over the borehole 232. As mentioned, the wellsite system 200 can include the rotary table 220 where the drillstring 225 pass through an opening in the rotary table 220.

As shown, the wellsite system 200 can include the kelly 218 and associated components, etc., or a top drive 240 and associated components. As to a kelly example, the kelly 218 may be a square or hexagonal metal/alloy bar with a hole drilled therein that serves as a mud flow path. The kelly 218 can be used to transmit rotary motion from the rotary table 220 via the kelly drive bushing 219 to the drillstring 225, while allowing the drillstring 225 to be lowered or raised during rotation. The kelly 218 can pass through the kelly drive bushing 219, which can be driven by the rotary table 220. As an example, the rotary table 220 can include a master bushing that operatively couples to the kelly drive bushing 219 such that rotation of the rotary table 220 can turn the kelly drive bushing 219 and hence the kelly 218. The kelly drive bushing 219 can include an inside profile matching an outside profile (e.g., square, hexagonal, etc.) of the kelly 218; however, with slightly larger dimensions so that the kelly 218 can freely move up and down inside the kelly drive bushing 219.

As to a top drive example, the top drive 240 can provide functions performed by a kelly and a rotary table. The top drive 240 can turns the drillstring 225. As an example, the top drive 240 can include one or more motors (e.g., electric and/or hydraulic) connected with appropriate gearing to a short section of pipe called a quill, that in turn may be screwed into a saver sub or the drillstring 225 itself. The top drive 240 can be suspended from the traveling block 211, so the rotary mechanism is free to travel up and down the derrick 214. As an example, a top drive 240 may allow for drilling to be done with more joint stands than a kelly/rotary table approach.

In the example of FIG. 2, the mud tank 201 can hold mud, which can be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via a the lines 206, 208 and 209 to a port of the kelly 218 or, for example, to a port of the top drive 240. The mud can then flow via a passage (e.g., or passages) in the drillstring 225 and out of ports located on the drill bit 226 (see, e.g., a directional arrow). As the mud exits the drillstring 225 via ports in the drill bit 226, it can then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drill string 225 may be pulled from a wellbore and optionally replaced, for example, with a new or sharpened drill bit, a smaller diameter drill string, etc. As mentioned, the act of pulling a drill string out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drill string 225 at a bottom of a wellbore, pumping of the mud commences to lubricate the drill bit 226 for purposes of drilling to enlarge the wellbore. As mentioned, the mud can be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may modulated. In such an example, information from downhole equipment (e.g., one or more modules of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud can cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 (e.g., a surface system, etc.) may include circuitry to sense pressure pulses generated by telemetry equipment 252 and, for example, communicate sensed pressure pulses or information derived therefrom for process, control, etc.

The assembly 250 of the illustrated example includes a logging-while-drilling (LWD) module 254, a measuring-while-drilling (MWD) module 256, an optional module 258, a roto-steerable system and motor 260, and the drill bit 226.

The LWD module 254 may be housed in a suitable type of drill collar and can contain one or a plurality of selected types of logging tools. It will also be understood that more than one LWD and/or MWD module can be employed, for example, as represented at by the module 256 of the drillstring assembly 250. Where the position of an LWD module is mentioned, as an example, it may refer to a module at the position of the LWD module 254, the module 256, etc. An LWD module can include capabilities for measuring, processing, and storing information, as well as for communicating with the surface equipment. In the illustrated example, the LWD module 254 may include a seismic measuring device.

The MWD module 256 may be housed in a suitable type of drill collar and can contain one or more devices for measuring characteristics of the drillstring 225 and the drill bit 226. As an example, the MWD tool 254 may include equipment for generating electrical power, for example, to power various components of the drillstring 225. As an example, the MWD tool 254 may include the telemetry equipment 252, for example, where the turbine impeller can generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

FIG. 2 also shows some examples of types of holes that may be drilled. For example, consider a slant hole 272, an S-shaped hole 274, a deep inclined hole 276 and a horizontal hole 278.

As an example, a drilling operation can include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees.

As an example, a directional well can include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of a downhole motor and/or a turbine. As to a motor, for example, a drillstring can include a positive displacement motor (PDM).

As an example, a system may be a steerable system and include equipment to perform method such as geosteering. As an example, a steerable system can include a PDM or of a turbine on a lower part of a drillstring which, just above a drill bit, a bent sub can be mounted. As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment can make it possible to send to the surface various types of data of interest, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, can allow for implementing a geosteering method. Such a method can include navigating a subsurface environment, for example, to follow a desired route to reach a desired target or targets.

As an example, a drillstring can include an azimuthal density neutron (AND) tool for measuring density and porosity; a MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

As an example, geosteering can include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 can include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensor may be at an offset wellsite where the wellsite system 200 and the offset wellsite are in a common field (e.g., oil and/or gas field).

As an example, one or more of the sensors 264 can be provided for tracking pipe, tracking movement of at least a portion of a drillstring, etc.

As an example, the system 200 can include one or more sensors 266 that can sense and/or transmit signals to a fluid conduit such as a drilling fluid conduit (e.g., a drilling mud conduit). For example, in the system 200, the one or more sensors 266 can be operatively coupled to portions of the standpipe 208 through which mud flows. As an example, a downhole tool can generate pulses that can travel through the mud and be sensed by one or more of the one or more sensors 266. In such an example, the downhole tool can include associated circuitry such as, for example, encoding circuitry that can encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 can include a transmitter that can generate signals that can be transmitted downhole via mud (e.g., drilling fluid) as a transmission medium.

As an example, one or more portions of a drillstring may become stuck. The term stuck can refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

Figure 3:
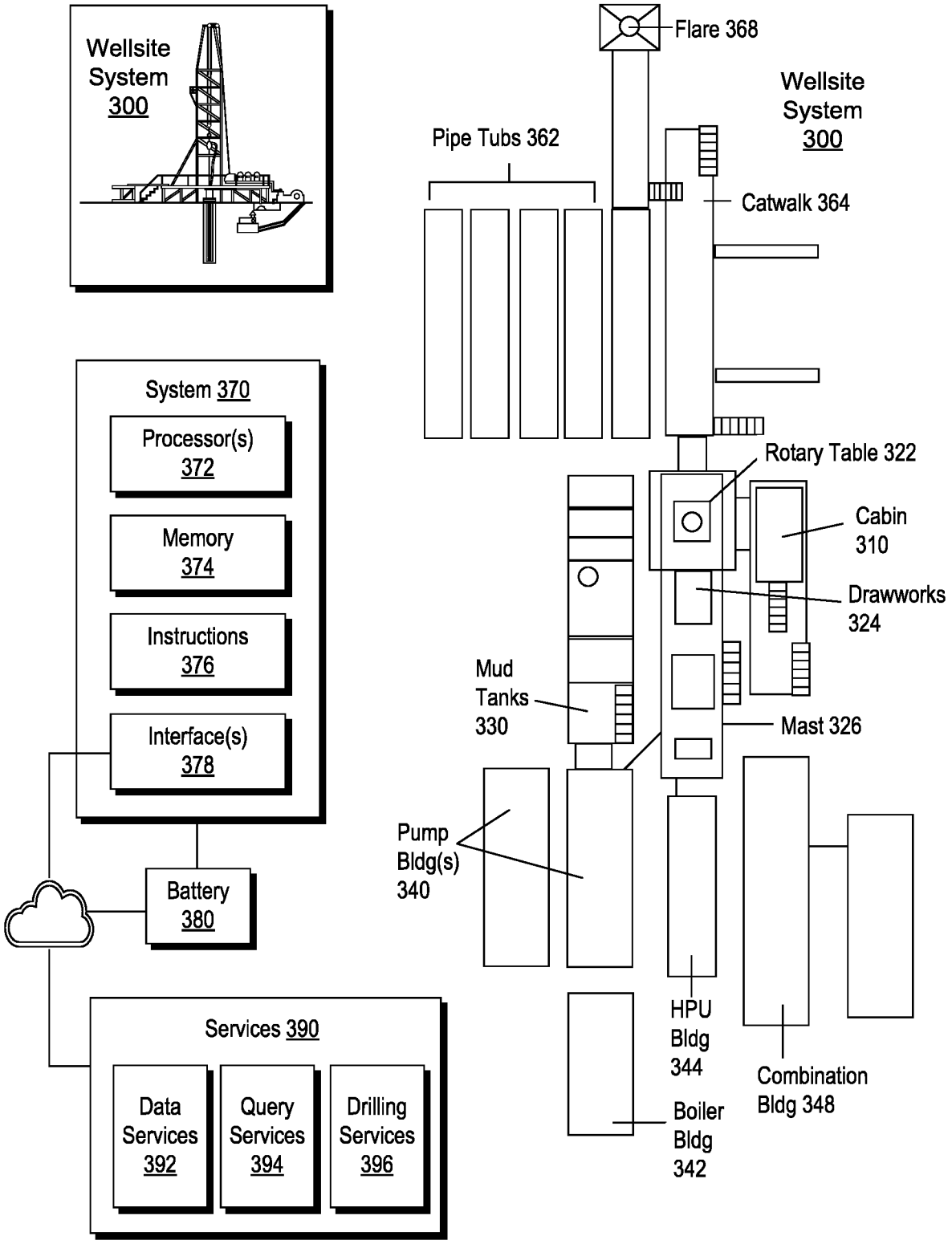
FIG. 3 illustrates an example of a wellsite system and an example of a computational system.

FIG. 3 shows an example of a wellsite system 300, specifically, FIG. 3 shows the wellsite system 300 in an approximate side view and an approximate plan view along with a block diagram of a system 370.

In the example of FIG. 3, the wellsite system 300 can include a cabin 310, a rotary table 322, drawworks 324, a mast 326 (e.g., optionally carrying a top drive, etc.), mud tanks 330 (e.g., with one or more pumps, one or more shakers, etc.), one or more pump buildings 340, a boiler building 342, an HPU building 344 (e.g., with a rig fuel tank, etc.), a combination building 348 (e.g., with one or more generators, etc.), pipe tubs 362, a catwalk 364, a flare 368, etc. Such equipment can include one or more associated functions and/or one or more associated operational risks, which may be risks as to time, resources, and/or humans.

As shown in the example of FIG. 3, the wellsite system 300 can include a system 370 that includes one or more processors 372, memory 374 operatively coupled to at least one of the one or more processors 372, instructions 376 that can be, for example, stored in the memory 374, and one or more interfaces 378. As an example, the system 370 can include one or more processor-readable media that include processor-executable instructions executable by at least one of the one or more processors 372 to cause the system 370 to control one or more aspects of the wellsite system 300. In such an example, the memory 374 can be or include the one or more processor-readable media where the processor-executable instructions can be or include instructions. As an example, a processor-readable medium can be a computer-readable storage medium that is not a signal and that is not a carrier wave (e.g., consider a storage medium that is a storage device).

FIG. 3 also shows a battery 380 that may be operatively coupled to the system 370, for example, to power the system 370. As an example, the battery 380 may be a back-up battery that operates when another power supply is unavailable for powering the system 370. As an example, the battery 380 may be operatively coupled to a network, which may be a cloud network. As an example, the battery 380 can include smart battery circuitry and may be operatively coupled to one or more pieces of equipment via a SMBus or other type of bus.

In the example of FIG. 3, services 390 are shown as being available, for example, via a cloud platform. Such services can include data services 392, query services 394 and drilling services 396.

Figure 4:
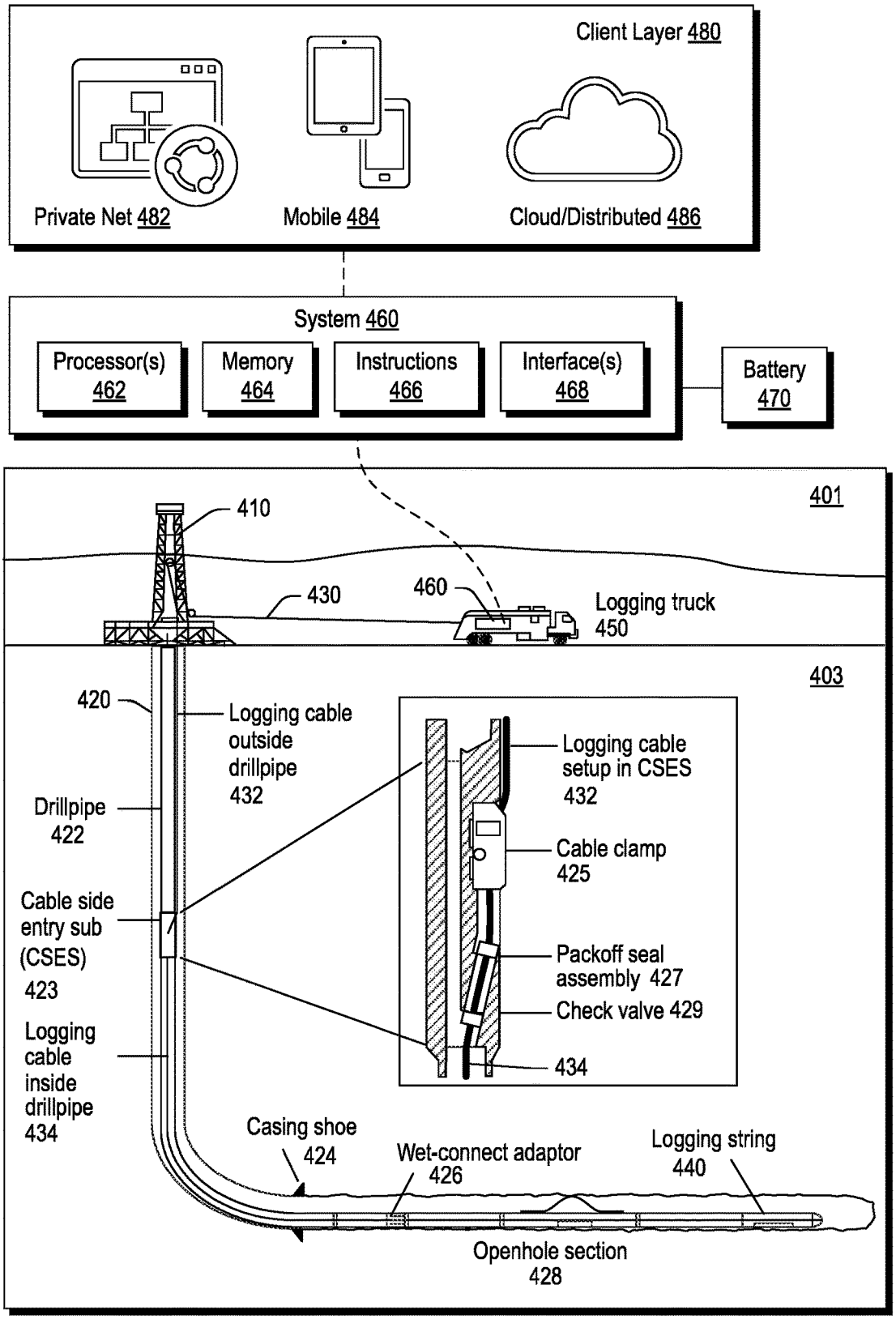
FIG. 4 illustrates an example of a wireline services system as deployed in a geologic environment.

FIG. 4 shows an example of an environment 401 that includes a subterranean portion 403 where a rig 410 is positioned at a surface location above a bore 420. In the example of FIG. 4, various wirelines services equipment can be operated to perform one or more wirelines services including, for example, acquisition of data from one or more positions within the bore 420.

In the example of FIG. 4, the bore 420 includes drillpipe 422, a casing shoe, a cable side entry sub (CSES) 423, a wet-connector adaptor 426 and an openhole section 428. As an example, the bore 420 can be a vertical bore or a deviated bore where one or more portions of the bore may be vertical and one or more portions of the bore may be deviated, including substantially horizontal.

In the example of FIG. 4, the CSES 423 includes a cable clamp 425, a packoff seal assembly 427 and a check valve 429. These components can provide for insertion of a logging cable 430 that includes a portion 432 that runs outside the drillpipe 422 to be inserted into the drillpipe 422 such that at least a portion 434 of the logging cable runs inside the drillpipe 422. In the example of FIG. 4, the logging cable 430 runs past the wet-connect adaptor 426 and into the openhole section 428 to a logging string 440.

As shown in the example of FIG. 4, a logging truck 450 (e.g., a wirelines services vehicle) can deploy the wireline 430 under control of a system 460. As shown in the example of FIG. 4, the system 460 can include one or more processors 462, memory 464 operatively coupled to at least one of the one or more processors 462, instructions 466 that can be, for example, stored in the memory 464, and one or more interfaces 468. As an example, the system 460 can include one or more processor-readable media that include processor-executable instructions executable by at least one of the one or more processors 462 to cause the system 460 to control one or more aspects of equipment of the logging string 440 and/or the logging truck 450. In such an example, the memory 464 can be or include the one or more processor-readable media where the processor-executable instructions can be or include instructions. As an example, a processor-readable medium can be a computer-readable storage medium that is not a signal and that is not a carrier wave.

FIG. 4 also shows a battery 470 that may be operatively coupled to the system 460, for example, to power the system 460. As an example, the battery 470 may be a back-up battery that operates when another power supply is unavailable for powering the system 460 (e.g., via a generator of the wirelines truck 450, a separate generator, a power line, etc.). As an example, the battery 470 may be operatively coupled to a network, which may be a cloud network. As an example, the battery 470 can include smart battery circuitry and may be operatively coupled to one or more pieces of equipment via a SMBus or other type of bus.

As an example, the system 460 can be operatively coupled to a client layer 480. In the example of FIG. 4, the client layer 480 can include features that allow for access and interactions via one or more private networks 482, one or more mobile platforms and/or mobile networks 484 and via the "cloud" 486, which may be considered to include distributed equipment that forms a network such as a network of networks. As an example, the system 460 can include circuitry to establish a plurality of connections (e.g., sessions). As an example, connections may be via one or more types of networks. As an example, connections may be client-server types of connections where the system 460 operates as a server in a client-server architecture. For example, clients may log-in to the system 460 where multiple clients may be handled, optionally simultaneously.

FIGS. 1, 2, 3 and 4 show various examples of equipment in various examples of environments. As an example, one or more workflows may be implemented to perform operations using equipment in one or more environments. As an example, a workflow may aim to understand an environment. As an example, a workflow may aim to drill into an environment, for example, to form a bore defined by surrounding earth (e.g., rock, fluids, etc.). As an example, a workflow may aim to support a bore, for example, via casing. As an example, a workflow may aim to fracture an environment, for example, via injection of fluid. As an example, a workflow may aim to produce fluids from an environment via a bore. As an example, a workflow may utilize one or more frameworks that operate at least in part via a computer (e.g., a computing device, a computing system, etc.).

As an example, a workflow can include utilizing a seismic-to-simulation framework such as, for example, the PETREL® framework (Schlumberger Limited, Houston, Tex.), and/or a workflow can include utilizing a technical data framework such as, for example, the TECHLOG® framework (Schlumberger Limited, Houston, Tex.).

As an example, a framework can include entities that may include earth entities, geological objects or other objects such as wells, surfaces, reservoirs, etc. Entities can include virtual representations of actual physical entities that are reconstructed for purposes of one or more of evaluation, planning, engineering, operations, etc.

Entities may include entities based on data acquired via sensing, observation, etc. (e.g., seismic data and/or other information). An entity may be characterized by one or more properties (e.g., a geometrical pillar grid entity of an earth model may be characterized by a porosity property). Such properties may represent one or more measurements (e.g., acquired data), calculations, etc.

A framework may be an object-based framework. In such a framework, entities may include entities based on predefined classes, for example, to facilitate modeling, analysis, simulation, etc. A commercially available example of an object-based framework is the MICROSOFT™ .NET™ framework (Redmond, Wash.), which provides a set of extensible object classes. In the .NET™ framework, an object class encapsulates a module of reusable code and associated data structures. Object classes can be used to instantiate object instances for use in by a program, script, etc. For example, borehole classes may define objects for representing boreholes based on well data.

As an example, a framework can include an analysis component that may allow for interaction with a model or model-based results (e.g., simulation results, etc.). As to simulation, a framework may operatively link to or include a simulator such as the ECLIPSE® reservoir simulator (Schlumberger Limited, Houston Tex.), the INTERSECT® reservoir simulator (Schlumberger Limited, Houston Tex.), etc.

The aforementioned PETREL® framework provides components that allow for optimization of exploration and development operations. The PETREL® framework includes seismic to simulation software components that can output information for use in increasing reservoir performance, for example, by improving asset team productivity. Through use of such a framework, various professionals (e.g., geophysicists, geologists, well engineers, reservoir engineers, etc.) can develop collaborative workflows and integrate operations to streamline processes. Such a framework may be considered an application and may be considered a data-driven application (e.g., where data is input for purposes of modeling, simulating, etc.).

As an example, one or more frameworks may be interoperative and/or run upon one or another. As an example, consider the commercially available framework environment marketed as the OCEAN® framework environment (Schlumberger Limited, Houston, Tex.), which allows for integration of add-ons (or plug-ins) into a PETREL® framework workflow. The OCEAN® framework environment leverages .NET™ tools (Microsoft Corporation, Redmond, Wash.) and offers stable, user-friendly interfaces for efficient development. In an example embodiment, various components may be implemented as add-ons (or plug-ins) that conform to and operate according to specifications of a framework environment (e.g., according to application programming interface (API) specifications, etc.).

As an example, a framework can include a model simulation layer along with a framework services layer, a framework core layer and a modules layer. The framework may include the commercially available OCEAN® framework where the model simulation layer can include or operatively link to the commercially available PETREL® model-centric software package that hosts OCEAN® framework applications. In an example embodiment, the PETREL® software may be considered a data-driven application. The PETREL® software can include a framework for model building and visualization. Such a model may include one or more grids.

As an example, a model simulation layer may provide domain objects, act as a data source, provide for rendering and provide for various user interfaces. Rendering may provide a graphical environment in which applications can display their data while the user interfaces may provide a common look and feel for application user interface components.

As an example, domain objects can include entity objects, property objects and optionally other objects. Entity objects may be used to geometrically represent wells, surfaces, reservoirs, etc., while property objects may be used to provide property values as well as data versions and display parameters. For example, an entity object may represent a well where a property object provides log information as well as version information and display information (e.g., to display the well as part of a model).

As an example, data may be stored in one or more data sources (or data stores, generally physical data storage devices), which may be at the same or different physical sites and accessible via one or more networks. As an example, a model simulation layer may be configured to model projects. As such, a particular project may be stored where stored project information may include inputs, models, results and cases. Thus, upon completion of a modeling session, a user may store a project. At a later time, the project can be accessed and restored using the model simulation layer, which can recreate instances of the relevant domain objects.

As an example, a system may be used to perform one or more workflows. A workflow may be a process that includes a number of worksteps. A workstep may operate on data, for example, to create new data, to update existing data, etc. As an example, a workflow may operate on one or more inputs and create one or more results, for example, based on one or more algorithms. As an example, a system may include a workflow editor for creation, editing, executing, etc. of a workflow. In such an example, the workflow editor may provide for selection of one or more pre-defined worksteps, one or more customized worksteps, etc. As an example, a workflow may be a workflow implementable at least in part in the PETREL® software, for example, that operates on seismic data, seismic attribute(s), log data, etc. As an example, a workflow may be a process implementable at least in part in the OCEAN® framework. As an example, a workflow may include one or more worksteps that access a module such as a plug-in (e.g., external executable code, etc.).

As an example, a framework may provide for modeling petroleum systems. For example, the commercially available modeling framework marketed as the PETROMOD® framework (Schlumberger Limited, Houston, Tex.) includes features for input of various types of information (e.g., seismic, well, geological, etc.) to model evolution of a sedimentary basin. The PETROMOD® framework provides for petroleum systems modeling via input of various data such as seismic data, well data and other geological data, for example, to model evolution of a sedimentary basin. The PETROMOD® framework may predict if, and how, a reservoir has been charged with hydrocarbons, including, for example, the source and timing of hydrocarbon generation, migration routes, quantities, pore pressure and hydrocarbon type in the subsurface or at surface conditions. In combination with a framework such as the PETREL® framework, workflows may be constructed to provide basin-to-prospect scale exploration solutions. Data exchange between frameworks can facilitate construction of models, analysis of data (e.g., PETROMOD® framework data analyzed using PETREL® framework capabilities), and coupling of workflows.

As mentioned, wireline services can include deployment of one or more tools in a bore in a geologic environment, for example, as drilled via a rig. Wireline services can include acquiring petrophysical measurements that can, for example, help to determine petrophysical properties of a reservoir, its fluid contents, etc. Some examples of wireline services tools include a lithology scanner spectrometer (e.g., to measure elements and quantitatively determine total organic carbon (TOC) in a wide variety of formations), a dielectric scanner (e.g., to measure water volume and rock textural information to determine hydrocarbon volume, whether in carbonates, shaly or laminated sands, or heavy oil reservoirs), a magnetic resonance scanner (e.g., to acquire NMR measurement of porosity, permeability, and fluid volumes), an Rt scanner (e.g., to acquire resistivity measurements germane to formation dip, anisotropy, beds, etc.), a sonic scanner acoustic scanning platform (e.g., to understand a reservoir stress regime and anisotropy through 3D acoustic measurements made axially, azimuthally, and/or radially), an analysis behind casing tool, (e.g., well log data—including the collection of fluid samples—in cased holes to find bypassed pay, etc.), etc.

As mentioned, wireline services can include conveyance of equipment in a bore of a geologic environment. Conveyance can be performed by a crew in a hands-on manner to account for bore characteristics, particularly bore geometries. As an example, complex well geometries and extended bore depths can present challenges for conveyance by wireline services crew. As an example, deep and highly deviated bores can pose safety and logistics concerns. Where challenges exist, delays may be incurred, particularly as to decisions as to how to proceed. Expertise can vary from crew to crew, which can result in variations in setup of wireline services equipment, operation thereof, and associated risks to people and equipment.

As an example, a tool may be configured to acquire electrical borehole images. As an example, the fullbore Formation Microlmager (FMI) tool (Schlumberger Limited, Houston, Tex.) can acquire borehole image data. A data acquisition sequence for such a tool can include running the tool into a borehole with acquisition pads closed, opening and pressing the pads against a wall of the borehole, delivering electrical current into the material defining the borehole while translating the tool in the borehole, and sensing current remotely, which is altered by interactions with the material.

Analysis of information may reveal features such as, for example, vugs, dissolution planes (e.g., dissolution along bedding planes), stress-related features, dip events, etc. As an example, a tool may acquire information that may help to characterize a reservoir, optionally a fractured reservoir where fractures may be natural and/or artificial (e.g., hydraulic fractures).

As an example, information acquired by a tool or tools may be analyzed using a framework such as the TECHLOG® framework. As an example, the TECHLOG® framework can be interoperable with one or more other frameworks such as, for example, the PETREL® framework.

Figure 5:
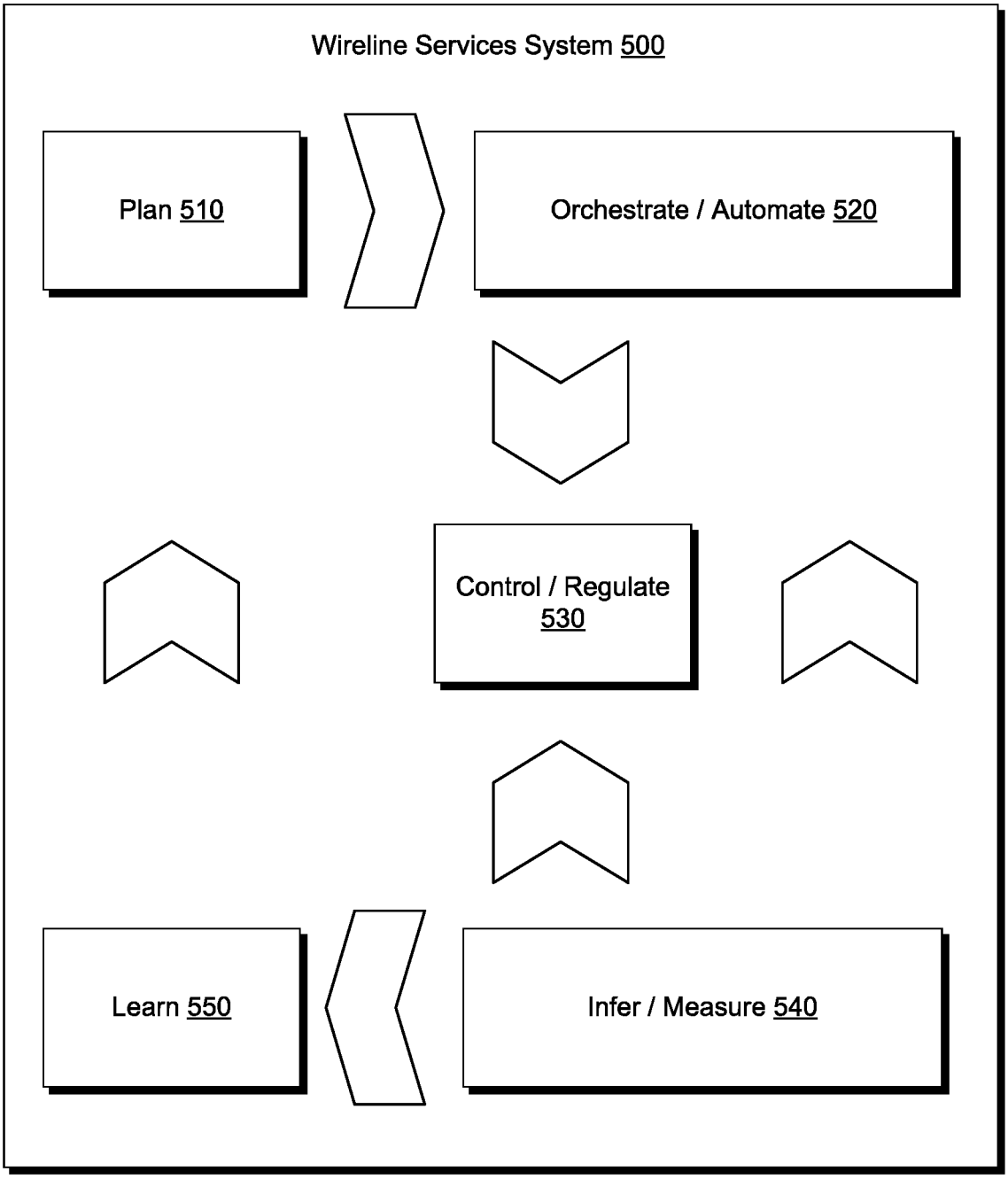
FIG. 5 illustrates an example of a wireline services system.

FIG. 5 shows an example of a wireline services system 500 that includes a planning block 510, an orchestration and/or automation block 520, a control and/or regulation block 530, an inference and/or measurement block 540 and a learning block 550. In the example of FIG. 5, the system 500 can include data flows. For example, data can flow to the control and/or regulation block 530.

As an example, the system 500 may be implemented at least in part using the system 460 of FIG. 4. For example, one or more pieces of equipment can be field equipment that is deployed in an environment, for example, via a logging vehicle (e.g., a wirelines services vehicle). As an example, field equipment can include a computer, which may be a server.

A server can include processor-executable instructions stored in memory that can be executed to establish one or more operating system environments. As an example, instructions can be included to establish a virtual machine (VM) or virtual machines (VMs). As an example, an OS environment and/or a VM may execute application code, communication code, etc., that cause a server to perform various actions where such actions can include wireline services and/or associated actions.

As an example, a server can include multiple processors where each processor includes multiple cores. As an example, a server can include a controller such as, for example, a baseboard management controller (BMC), that can manage various pieces of equipment included in the server. As an example, a server can include multiple interfaces. For example, consider an in-band interface and an out-of-band interface where an in-band interface may operate under instructions executed within an operating system environment and where an out-of-band interface may operate under instructions of a lightweight operating system environment, which may be a real-time operating system environment (e.g., RTOS environment). As an example, a controller may be included in a server where the controller includes a processor (e.g., microcontroller, etc.) that can access RTOS instructions to establish an RTOS environment, which may operatively control one or more interfaces (e.g., IP, cellular, satellite, etc.).

As an example, a server can include different types of network circuitry. As an example, a server can include one or more of cellular network circuitry as may be utilized in cellular phones, satellite network circuitry as may be used in satellite phones, WiFi circuitry as may be used to operatively couple a device to the Internet, etc. As an example, a server can include a GPS chip and/or other geographic location circuitry.

As an example, a server can include instructions and components to implement an architecture such as a client-server model architecture. As an example, a single server may serve multiple clients. As an example, a client process may connect over a network or networks to a server. As an example, a server can include instructions to perform various functions. As an example, functions can include one or more of database server functions, file server functions, mail server functions, web server functions, cellular server functions, satellite server functions, application server functions, etc.

As an example, a client-server model architecture can implement a request-response model. In such a model, a client can send a request to the server, which performs some action and sends a response back to the client, for example, with a result or acknowledgement.

As an example, a server may operate in one or more modes. For example, consider a user interactive mode where a client-server relationship is active for receiving requests by the server to instruct the server. In such an example, the user interactive mode can include performing one or more operations that are based at least in part on a model or models, which may model one or more physical aspects of wireline services equipment, a wellsite, etc. As an example, a user interactive mode can include defining a model, setting up a model, actuating a model, etc.

As another example, consider an automated mode where a server operates to a predefined extent without receipt of client generated requests that instruct the server. In such an example, the server may still be operatively coupled to a client and/or otherwise capable of transmitting information to a client device via at least one network such that the client device can monitor or otherwise be updated as to the status of operations of the automated mode. As an example, the automated model can be implemented at least in part via one or more models, which may model one or more physical aspects of wireline services equipment, a wellsite, etc.

As yet another example, consider a safe mode where a server may be decoupled from one or more networks and, for example, unable to successfully transmit information to a client device. In such an example, the server may operate to a predefined extent without receipt of client generated requests that instruct the server where such operations are limited based at least in part on a risk model or other model that accounts for a lack of communication with one or more client devices. Such a model or models may model one or more physical aspects of wireline services equipment, a wellsite, etc.

As an example, the system 500 of FIG. 5 can provide a methodology, process and architecture for deploying wireline logging units (e.g., land and offshore), optionally with one or more levels of automation in a manner that can support safe and efficient remote operations. Such a system may allow for operations to be performed in a manner that can reduce a number of crew members on site, improve job performance, repeatability and overall quality of service internally as to a service provider and to service customers.

As an example, a system can be a wireline implementation (e.g., via a wireline services vehicle) where the system includes substantial computational resources on-site (e.g., particularly for on-site data processing). For example, such a system can include a server.

As an example, a system may be configured to be set-up, operated and shut down on a timeframe that may be a few hours to a few days. For example, a wireline service may be performed by deploying equipment downhole, acquiring data using the equipment and then storing and/or communicating the acquired data, for example, as raw and/or as processed data. Such a service may be performed in a timeframe that may range from hours to a few days. In such an example, where the system is deployed using a vehicle, the vehicle may drive to another wellsite and repeat operations. As an example, a vehicle may be expected to perform wireline services at a number of wellsites in a field (e.g., consider about 10 or more wellsites within a week).

As an example, a system can include a model-based framework that is on-site (e.g., can be implemented as such because of the available computation resources on-site). For example, a server can include instructions stored in memory to implement a model-based framework that can model aspects of a wireline services operation at a wellsite. In such an example, the server through use of data, etc., may customize one or more models in a relatively rapid manner for a particular site. As an example, a model-based approach can allow for automation to expedite and/or for continued operation (e.g., where connection to a cloud fails, etc.). As an example, a model-based approach can provide one or more models for one or more corresponding modes (e.g., user interactive, automated, safe, etc.). As an example, a model-based approach can include transferring model information as well as acquired information (e.g., raw and/or processed data) to a file for storage (e.g., optionally cloud-based) once a job is complete (e.g., or during performance of the job, etc.). Such information may provide for learning, reporting, etc.

As an example, a system can include circuitry for cloud connectivity. For example, a system can be coupled to the cloud and utilize cloud resources. As an example, a system may receive information from the cloud, which may help to customize one or more models, instruct the system, etc. As an example, a system can transmit information to the cloud.

As an example, a system can include a server that is an on-site server, for example, a server transported by a wireline services vehicle. In such an example, the server can include or may be locally operatively coupled to circuitry that allows for one or more devices to connect (e.g., directly) to the server. As an example, such circuitry may be operable in a main connection mode, an auxiliary connection mode and/or a back-up connection mode. For example, a server can be configured for field operation in a single connection mode that is a direct connection mode (e.g., can be run directly via satellite, cell, WiFi, etc.). As an example, where a server has multiple modes of operation, a direct connection mode may be available where, for example, a cloud system is down. As an example, where a cloud system is down, an on-site system may go into a "safe" or "automated" mode. In such an example, the system may prompt a connection request via direct connection circuitry, for example, to remote cellular circuitry (e.g., a SIM chip of a computing device, etc.).

As an example, a server that allows for direct connectivity may facility managing scenarios, providing information, operations in a safe/automated mode. In such an example, such modes of operation may be enabled where there is at least some possibility of communicating data remotely via a direction connection mode. For example, satellite communication circuitry may be considered to be reliable and robust as back-ups exist to minimize risk of unavailability, downtime, etc.

As an example of a satellite communication system, consider the IRIDIUM™ satellite constellation (Iridium LLC, Washington D.C.) that can provide voice and data coverage to satellite phones, pagers and integrated transceivers over the Earth's entire surface. The IRIDIUM™ constellation includes over 60 active satellites in orbit, and additional spare satellites to serve in case of failure.

As an example, a system of a wireline services vehicle can be locally loaded such that a bulk of computational operations may be performed locally. Such computational operations can include decisions that are made locally rather than via receipt of instructions from a remote location.

As an example, a locally loaded system can reduce the number of subjectively and/or objectively unsafe/uncontrolled operations that can be executed by a remote user, which can potentially harm equipment or even personnel local at a wellsite (e.g., enabling remotely power of acquisition systems that could potentially harm local operators at the wellsite that would be handling electrical equipment).

As an example, a locally loaded system can help to ensure adequate wellsite intelligence as to one or more operations that are in part executed remotely, for example, to make sense of such requests based on what is happening at the wellsite. As an example, a locally loaded system can help to ensure, for example, that standard work instructions/operating procedures are followed.

As an example, a locally loaded system can increase efficiency as to user experience. For example, a locally loaded system can account for latencies that may exist in remote connections. For example, communications via satellite links can include multiple-second latencies. As an example, a locally loaded system can account for such latencies, for example, by implementing one or more operational modes that are immune to latencies of the order of a few seconds to a minute or more. For example, one or more operational modes can account for a complete lack of connectivity. As an example, a safe mode may be associated with a complete lack of connectivity over a period of time that is greater than about one minute. As an example, a locally loaded system can make decisions that aim to protect wireline equipment and/or personnel while still making progress as to a job, where feasible (e.g., according to a job plan, a risk model, etc.).

Referring again to FIG. 5, the system 500 can include integrating an automation controller and an orchestration framework in a wellsite logging unit (e.g., a server, etc.). In such an example, a client user interface (e.g., web-based, other UI, etc.) can be utilized from one or more remote locations.

As an example, a wellsite logging unit can be of a vehicle, an offshore skid or associated with other oil and gas infrastructure equipment. As an example, an automation controller can be included in a wellsite logging unit (e.g., land or offshore). As an example, an orchestration framework can be implemented at a wellsite, for example, for configuring and monitoring the automation controller, as well as executing high level activities of wireline operations. As an example, a cloud/hosted application may be utilized that can provide connectivity, data and control interoperability between wellsite, cloud, and office/town (e.g., remote device, etc.). As an example, a system can include a local application, for example, in the form of a desktop program (e.g., executable in a LINUX™ OS environment, a WINDOWS™ OS environment, an iOS™ OS environment, etc.). As an example, a system can include a browser based application that may be at least in part transmitted via one or more networks for installation on a client device.

As an example, a system can include a cloud/hosted application that communicates with a wellsite via push and/or pull mechanism and that is structured around services/micro-services that can be hosted on one or more private or public clouds.

As an example, a system can include, in the form of a desktop application (e.g., fat client) or web based (e.g., executing in a browser on a mobile or other computing device), a client application that can provide, for example, an interactive display showing one or more ongoing jobs being executed (e.g., field, country, global, etc.), which may be updated in real-time based on communication received by one or more individual connected wireline logging units.

As an example, an interactive display can provide for monitoring and control of a remote logging unit. For example, consider a display provides a wide range of information including but not limited to conveyance (e.g., winch) status, depth, logging unit status (e.g., engine, power generators, etc.), ongoing operation (e.g., logging, jarring, etc.), one or more fault conditions to be visible to a remote user, a number of audio and video of a wellsite for one or more selected areas by a remote user, means to communicate and collaborate with the local operator, etc.

As an example, a system can provide for wireline automation and, for example, orchestration of operations. As an example, an architecture can be based on modeling a number of aspects related to a logging unit, associated operations and the context (e.g., specific to a field, a wellsite, services, etc.). As an example, various facets can be incorporated in a model of a wellsite that can, for example, be managed and/or updated as a job execution proceeds.

As indicated in the example system 500 of FIG. 5, a workflow can include planning during job preparation, modeling of one or more job objectives and high level activities, controlling that can interface logical and physical world as well as sensory and inference information, which may be utilized for low level control and/or regulation and, for example, feedback to high level automation and orchestration. As shown in FIG. 5, learning can be captured and integrated where, for example, a plan can be updated as a job proceeds. Such an approach can result in objective adjustment as the operations unfold.

In the example of FIG. 5, various arrows show process flow from planning, orchestrating to controls, measurement and inference to learning and back to regulation and automation.

Figure 6:
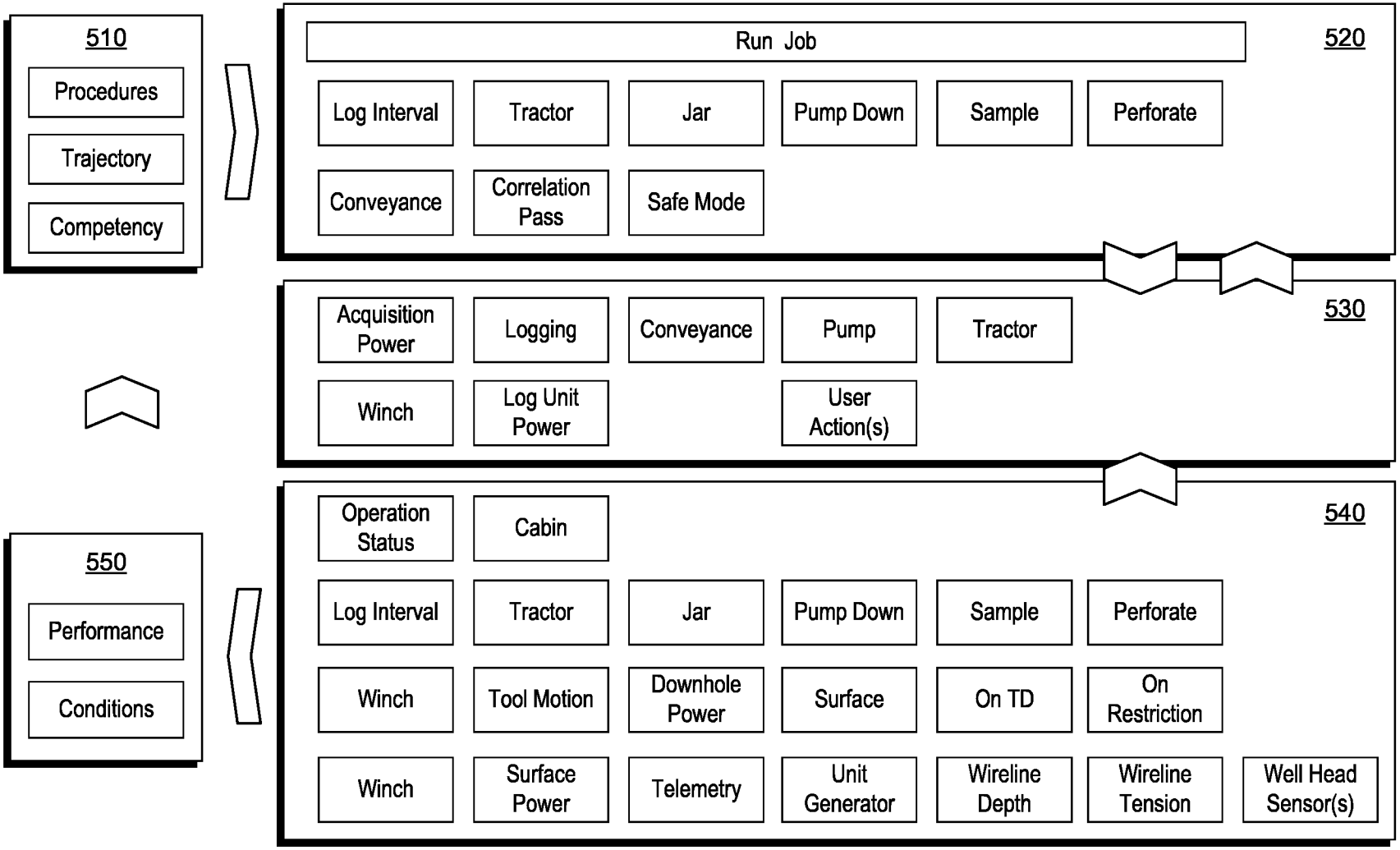
FIG. 6 illustrates an example of a wireline services system.

FIG. 6 shows the system 500 as populated with various features for one or more jobs. The example of FIG. 6 shows how the architecture of the system 500 can be utilized as to combining set of measures, inferences, controls, planned and learned attributes, high level job objectives as well as physical controls. In the example of FIG. 6, various arrows show an example of process flow from planning 510, to orchestration/automation 530 to control/regulation 530, to inference/measurement 540 to learning 550 and back to control/regulation 530 and orchestration/automation 520.

In the example of FIG. 6, the lower row of the inference and measurement block 540 can pertain to measurements that may be acquired during performance of one or more wireline services at a wellsite. As an example, measurements may be obtained via measuring physical values on surface and/or downhole. As an example, inferred measurements can be indirect where such inferences can pertain to conditions that may be directly measureable or not (e.g., due to lack of equipment, type of condition, etc.). As an example, a motion sensor in a logging unit may indicate presence of an operator in a cabin and infer that if the operator is alone at the rig site, the may not be on the rig floor.

Figure 7:
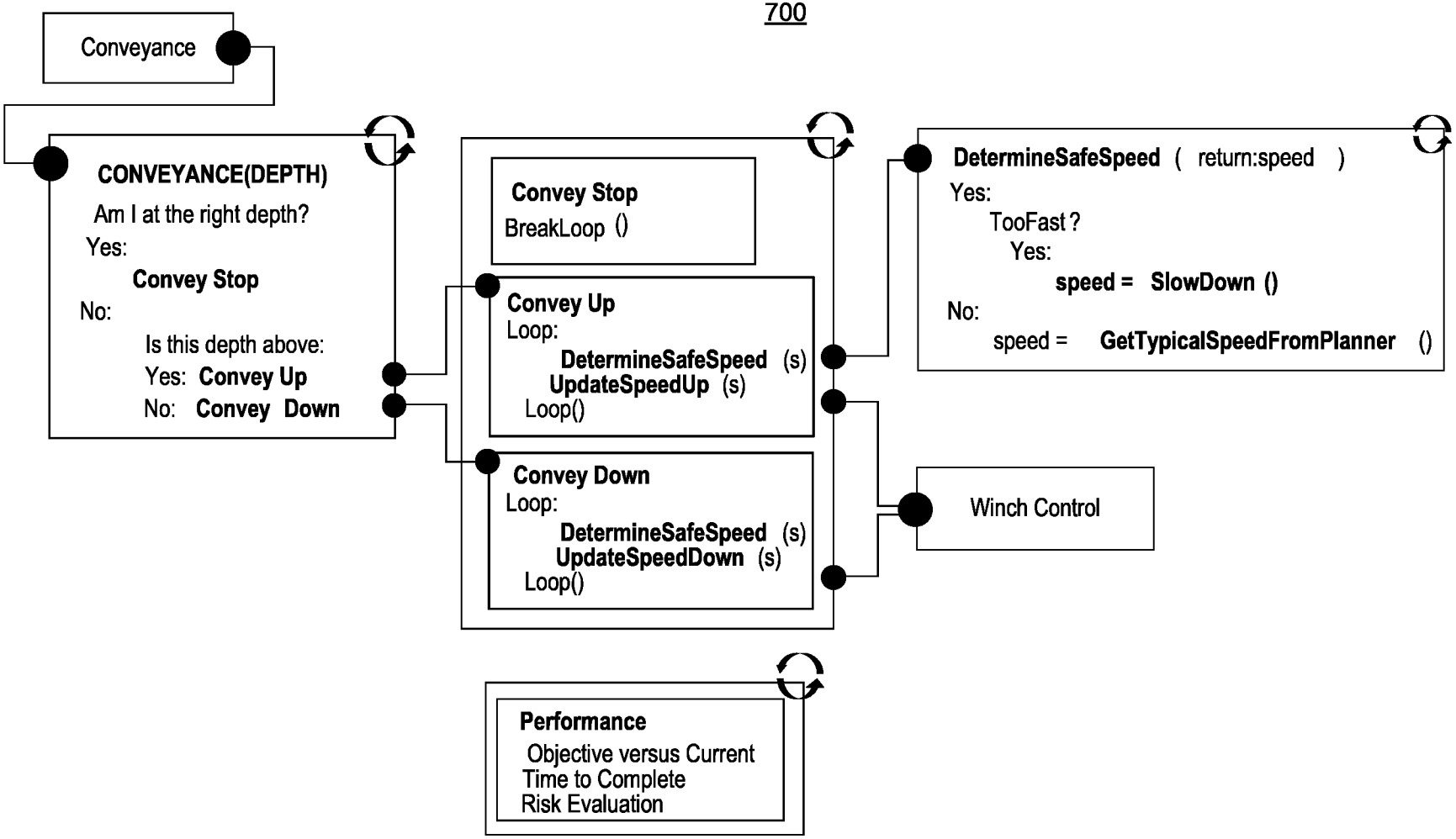
FIG. 7 illustrates an example of a logical process as implemented by a wirelines services system.

FIG. 7 shows an example of a logical process 700 that can be implemented for conveyance of one or more tools in a bore at a wellsite. Such a logical process may be implemented, for example, at least in part via a system that is present at the wellsite. For example, a logging truck can include a winch where the logging truck includes a server that can implement the logical process 700 for control of the winch and hence control of conveyance of the one or more tools in the bore at the wellsite.

As an example, a logical process may be specified in a domain specific language. For example, the example of FIG. 7 includes text that corresponds to a domain specific language (DSL) related to wirelines services. As an example, the logical process 700 may be part of an automatable process that can be performed in an automated mode and/or a safe mode by a system at a wellsite.

Figure 8:
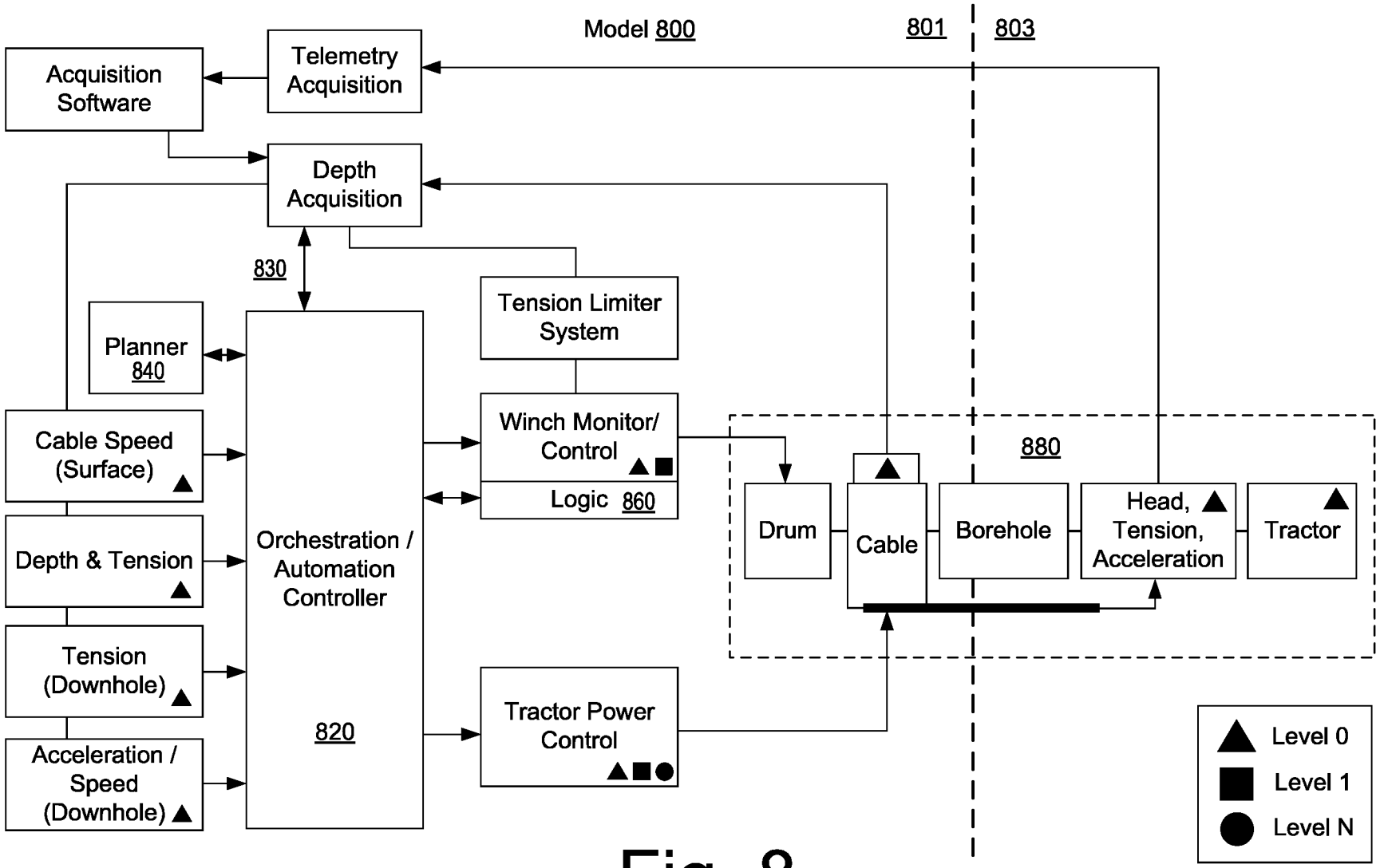
FIG. 8 illustrates an example of a model as implemented by a wireline services system.

FIG. 8 shows an example of a model 800 that can be implemented by a wireline services system such as the system 460 of FIG. 4. As shown, the model 800 includes features of the system 500 of FIG. 5. As shown, the model 800 includes a winch monitor/control block which can include logic 860. As an example, the logic can be associated with a logical process such as the logical process 700 of FIG. 7 (e.g., optionally specified at least in part via a DSL, etc.).

In the example of FIG. 8, the model 800 includes a surface portion 801 and a downhole portion 803. As shown, the model 800 includes a communication link 830 for communications between a depth acquisition block and a controller block 820 (e.g., an orchestration and/or automation controller). The model 800 also includes a link between the controller block 820 and the logic block 860 as associated with control of a winch monitor/control block for control of equipment 880 that can span the surface portion 801 and the downhole portion 803 of the model 800. In the example of FIG. 8, the model 800 can include various levels such as, for example, Level 0 (triangle symbol), Level 1 (square symbol) and Level 3 (circle symbol). As an example, a level may indicate a type of support for various components, units, etc. of the model 800.

In the example of FIG. 8, the model 800 operatively couples the winch monitor/control block to a drum block where the drum block can be operatively coupled to a cable block that represents a wireline cable (e.g., a logging cable). The cable block is also operatively coupled to a power line that is operatively coupled to a sensor block (e.g., head, tension, acceleration, etc. block). In the model 800, information of the sensor block can be transmitted via one or more telemetric acquisition systems per the telemetry acquisition block where such information can feedback into an orchestration and/or automation controller block 820. In such an example, information as to wireline tool(s) deployed downhole can be utilized in the logic of the winch monitor/control block, which can control the drum block (e.g., operatively coupled to a physical drum that can control conveyance).

As an example, the model 800 may be presented via one or more graphical user interfaces where a user may select, add, delete, etc., various components to rapidly construct a model suitable for use at a wellsite where one or more wireline services are to be performed. For example, where one or more sensors are available, the user may couple lines from a sensor block directly and/or indirectly to the orchestration and/or automation block. In such an example, the model "knows" what types of measurements can be expected to be available. In such an example, the orchestration and/or automation block can include building and/or implementing inference algorithms that can infer information based at least in part on what can be sensed (e.g., measured).

Figure 9:
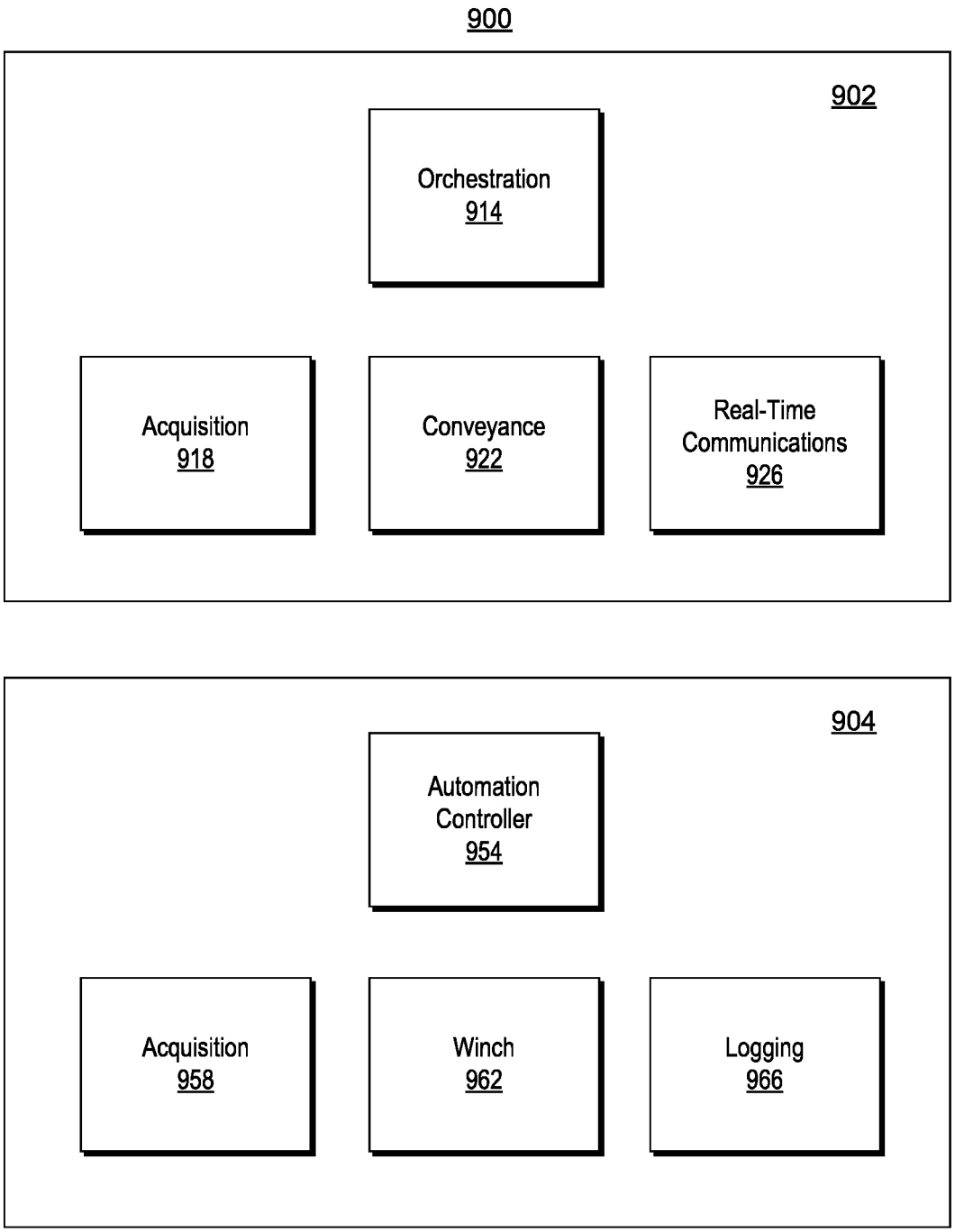
FIG. 9 illustrates an example of an architecture of a wireline services system.

FIG. 9 shows an example of an architecture 900 of a wellsite logging unit with segmented control networks 902 and 904, an orchestration block 914 and an automation controller block 954 in relationship with other components of the logging unit.

In the example, of FIG. 9, the automation controller block 954 can be in a wellsite logging unit (e.g., land or offshore).

Such an approach can include executing processes related to job operations. As an example, the automation controller block 954 can be deployed via a system that is reliable and that may be tamper-proof such that interactions are via a restricted mode of operation. For example, consider a physically sealed-server case and an application programming interface (API) for executing instructions received where the API may further be accessible via a particular network interface, which may be an in-band network interface. In such an example, the server can include an out-of-band network interface that is secure and accessible to one or more authorized users (e.g., for status monitoring, software/firmware upgrades, etc.). As an example, a server can act to implement a level of safety as can act as a gateway for certain controls and regulations in the unit.

As an example, the orchestration block 914 can be implemented at a wellsite, for example, for configuring and monitoring the automation controller block 954, as well as, for example, for executing high level activities of the wireline operations. As an example, the orchestration block 914 can be based on a combination of process execution based on sensory and inference inputs, managing the operation to execute sequential or concurrent activities to meet the job objective.

As an example, the automation architecture 900 can rest behind a segmented network to help to ensure integrity of a distributed low level winch and engine controls, while providing a gateway to interact with the orchestration block 914.

In the example of FIG. 9, the architecture 900 illustrates a few components, for example, an acquisition block 918, a conveyance block 922 and a real-time communications block 926 as being associated with the orchestration block 914 and an acquisition block 958, a winch block 962 and a logging block 966 as being associated with the automation controller block 954. In such an example, certain aspects can be at least in part isolated from others. For example, orchestration aspects can be isolated at least in part from automation aspects where the automation aspects can include features that aim to avoid risk (e.g., damage to people, equipment, etc.).

As an example, an architecture can include a hierarchy of trust where, for example, trust measures increase the closer the architecture is to actual equipment (e.g., a winch, a power controller, etc.). In such an example, instruction sets may be reduced. For example, more options may exist at an orchestration layer when compared to an automation layer. As an example, where APIs are implemented, APIs may be restricted at the automation layer more so than at the orchestration layer. For example, at an orchestration layer, user ID and source of message (e.g., API call) may be processed prior to allow fora response to a received message; whereas, at the automation layer, additional metrics may be considered such as, timing, prior messages, prior responses, etc. For example, at the automation layer, logic can exist that can determine if something is amiss as to what is being requested (e.g., an API call has been made three times in a row in a short period of time where a response had been sent and where further responses would be redundant). As an example, an automation layer can include protective measures that act to protect equipment and people from mishaps at a wellsite.

Figure 10:
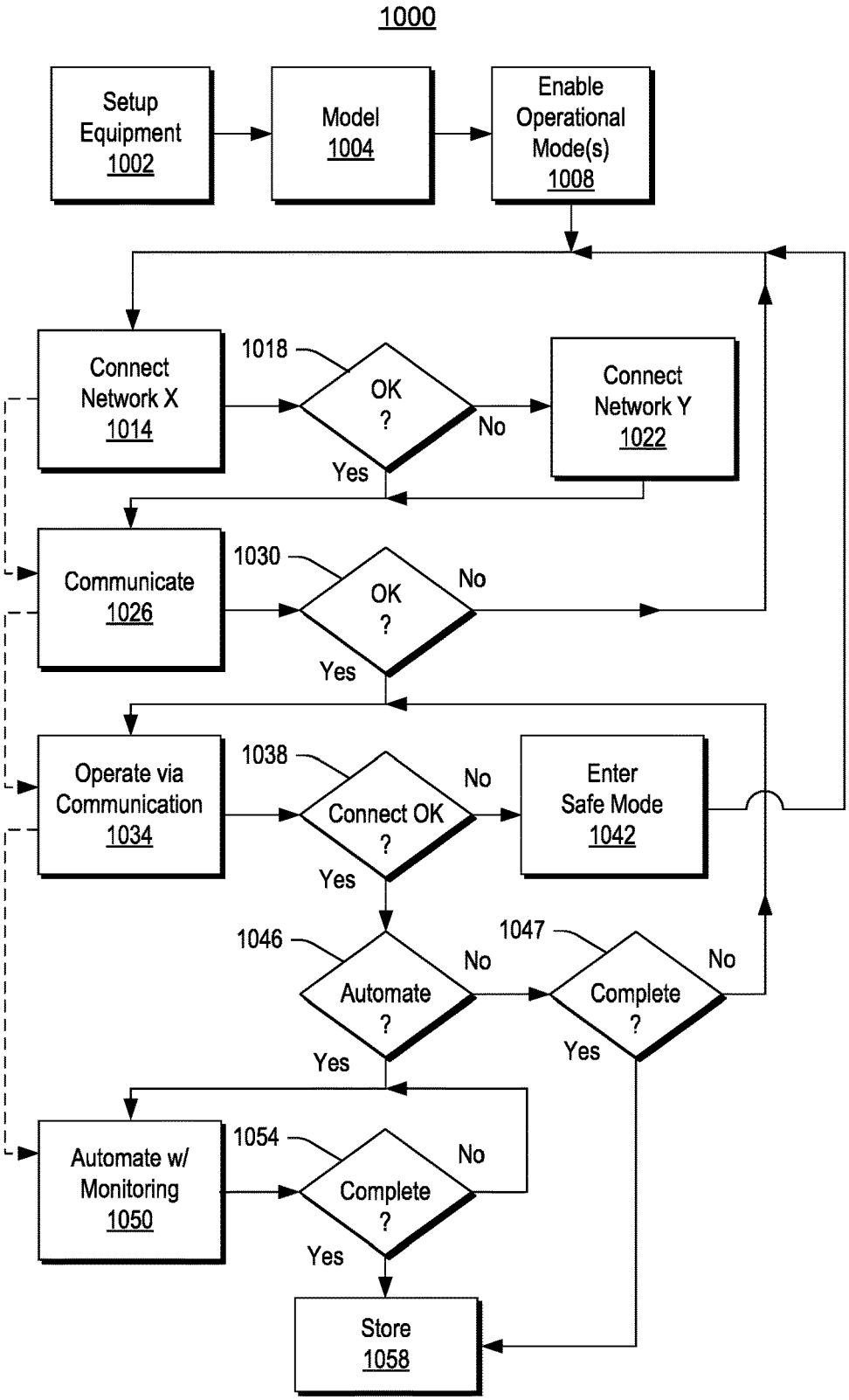
FIG. 10 illustrates an example of a method.

FIG. 10 shows an example of a method 1000 that includes a setup block 1002 for setting up equipment at a wellsite for performance of one or more wireline services, a model block 1004 for modeling at least a portion of the equipment, and an enable block 1008 for enabling one or more modes of operation as to at least a portion of the equipment at the wellsite.

In the example of FIG. 10, the method 1000 can proceed to a connection block 1014 where a connection may be made to a system at the wellsite via a network X (e.g., a first network) and where a decision block 1018 can decide if the connection is OK. In such an example, where the connection is not OK, the method 1000 can proceed to an alternative connection block 1022 for a network Y (e.g., a second network). Where a connection is possible, the method 1000 can proceed to a communication block 1026 where information may be communicated to the system at the wellsite (e.g., API calls, etc.).

As shown in FIG. 10, a decision block 1030 can decide whether communication is OK (e.g., a connection has not dropped, etc.). Where communication is not OK, the method 1000 can return to a connection block such as, for example, the connection block 1014 or the connection block 1022. Where the decision block 1030 decides that communication is OK, the method 1000 can continue to an operation block 1034 where, for example, the system at the wellsite can be instructed to operate based at least in part on a communication received by the system (e.g., via the network X or the network Y, etc.).

As shown in the example of FIG. 10, a decision block 1038 can decide if the connection is still OK and, if not, can instruct the system at the wellsite to enter a safe mode per a safe mode block 1042. Such a block can be implemented after communication has been established but then fails for one or more reasons such that one or more operations that may be ongoing are controlled to avoid risks to people and/or equipment at the wellsite. As shown, the safe mode block 1042 can cause the method 1000 to continue to a connection block, for example, to await one or more users' efforts to reconnect to the system at the wellsite. As an example, the decision block 1038 may operate using one or more criteria that can account for latency such as, for example, latency that may exist in a satellite based communication network (e.g., IRIDIUM™ system, etc.). For example, the decision block 1038 can be aware of the type of network that has been connected to for purposes of communication and can adapt accordingly to account for latency.

As shown in the example of FIG. 10, the method 1000 can include a decision block 1046 for deciding whether to enter an automated mode. Where the decision block 1046 decides to enter the automated mode, the method 1000 can continue to an automation block 1050 that can include monitoring, for example, to communicate information to a viable connection. Where the decision block 1046 decides to remain in the user interactive mode (e.g., operate via communication mode), a decision block 1047 can decide whether an operation is complete and, in response thereto, continue to a storage block 1058 for storing information as to the completed operation or continue to the operation block 1034.

In the example of FIG. 10, where the method 1000 operates in the automated mode, a decision block 1054 can decide whether an operation is complete and, for example, upon completion of the operation continue to the storage block 1058 or return to the automation block 1050. As an example, where a connection lapses during operation in the automated mode, the method 1000 may enter the safe mode 1042 per the block 1042. For example, where information as to operations being performed in the automated mode cannot be reliably transmitted via one or more communication networks, the method 1000 may enter the safe mode per the block 1042 and expect to receive one or more connection requests to reestablish a connection.

As an example, the method 1000 can be implemented using a server at a wellsite where the server includes at least one network interface and at least one interface for receiving and/or transmitting information to wireline services equipment at a wellsite. As an example, the storage block 1058 can include transmitting information from a server to a remote location via one or more networks (e.g., via a network interface of the server). As an example, such information may be utilized for purposes of another setting up of equipment and modeling thereof at another wellsite.

As an example, the method 1000 can include local and/or remote actions. For example, the model block 1004 may be executed locally and/or remotely. As an example, a local crew may model equipment set up at a wellsite. Or, for example, a remote client may log into a server that is aware of a set up at a wellsite such that modeling can be performed for the equipment (e.g., wireline services equipment, etc.). As an example, setting up can be expected to involve one or more crew members at a wellsite; whereas, for example, the blocks 1014 onward may be performed optionally without a crew member at the wellsite.

As an example, one or more crew members at a wellsite may perform actions of the blocks 1002, 1004 and 1008. For example, when properly set up and modeled, a member of crew may enable one or more operational modes, which may effectively hand over control to one or more remote clients. As mentioned, a server at a wellsite may be tamper-proof such that local crew cannot intervene is particular operations, which may include individually powering up or down the server. For example, the server may be linked to one or more other pieces of equipment that once they are powered up, the server is powered up as well. As an example, a server can include an out-of-band network interface that can be operatively coupled to communication circuitry. When connected, such an interface may operate according to a wake-on-LAN type of procedure, for example, by listening for a magic packet that can instruct the server to commence out-of-band communications, which, for example, may pertain to the server itself (e.g., components thereof, firmware, etc.).

As an example, a wireline services system can include calculating latency or latencies for one or more operations. For example, a wireline services system can include circuitry (e.g., software and/or hardware) for latency compensation and, for example, state prediction.

As an example, a method can include operating equipment at a wellsite where one or more network latencies can vary, for example, from an order of about hundreds of milliseconds to an order of about seconds. In such an example, data and/or control signals can be delayed as they transit various media, equipment, etc., which may be associated with different geographical locations, etc. As mentioned, latency may be associated with a type of communication (e.g., satellite, cloud, etc.). As an example, a wireline services system can be at a wellsite and may be considered to be an edge network of the cloud. As an example, when remotely operating equipment (e.g., city office site, etc.), a method can include determining a current status as to latency and, for example, a least latency that can be expected when displaying information to a user or to remote/cloud intelligence. In such an example, safety and efficiency of operations may be enhanced by accounting for such latency.

As an example, a system can include one or more latency sensors. For example, a sensor measurement along time may be amenable to extrapolation as to future values within a predictable range of accuracy where accuracy can diminish with respect to a time ahead of a prediction.

As an example, a method can include operating a winch for lowering a wireline toolstring/equipment at a given speed. In such an example, a system can include extrapolating a future depth of one or more sensors based at least in part on, for example, understanding of inertia of the winch, which may be unable to change speed due to a bounded acceleration rate. In such an example, where information displayed in an office is delayed by X seconds, an extrapolated future depth may be determined and rendered to a display of the user in the office.

As an example, a system can provide for determination of one or more latencies and modeling of equipment behavior, etc., based at least in part thereon where information may be communicated to a remote location that accounts for such latencies (e.g., via a prediction model or models). As an example, a latency component of a system can reside remote from a wellsite and remote from a client device. For example, a latency component that makes predictions based on one or more latencies can exist in the cloud. For example, such a component can predict a depth compensated for latency where such a depth is a future prediction with a quantifiable amount of uncertainty. Such an approach can allow a user to make a decision sooner, for example, to comport with one or more particular safety and/or efficiency objectives.

As an example, a wireline services system can include one or more latency determination components where such determinations can account for latency in one or more communications systems, telemetry systems, network systems, etc.

As an example, wireline services system can transition from one mode to another mode based at least in part on latency information. For example, where a communication that may be expected does not arrive within a latency window, a system may transition from one mode to a more "safe" mode of operation.

Figure 11:
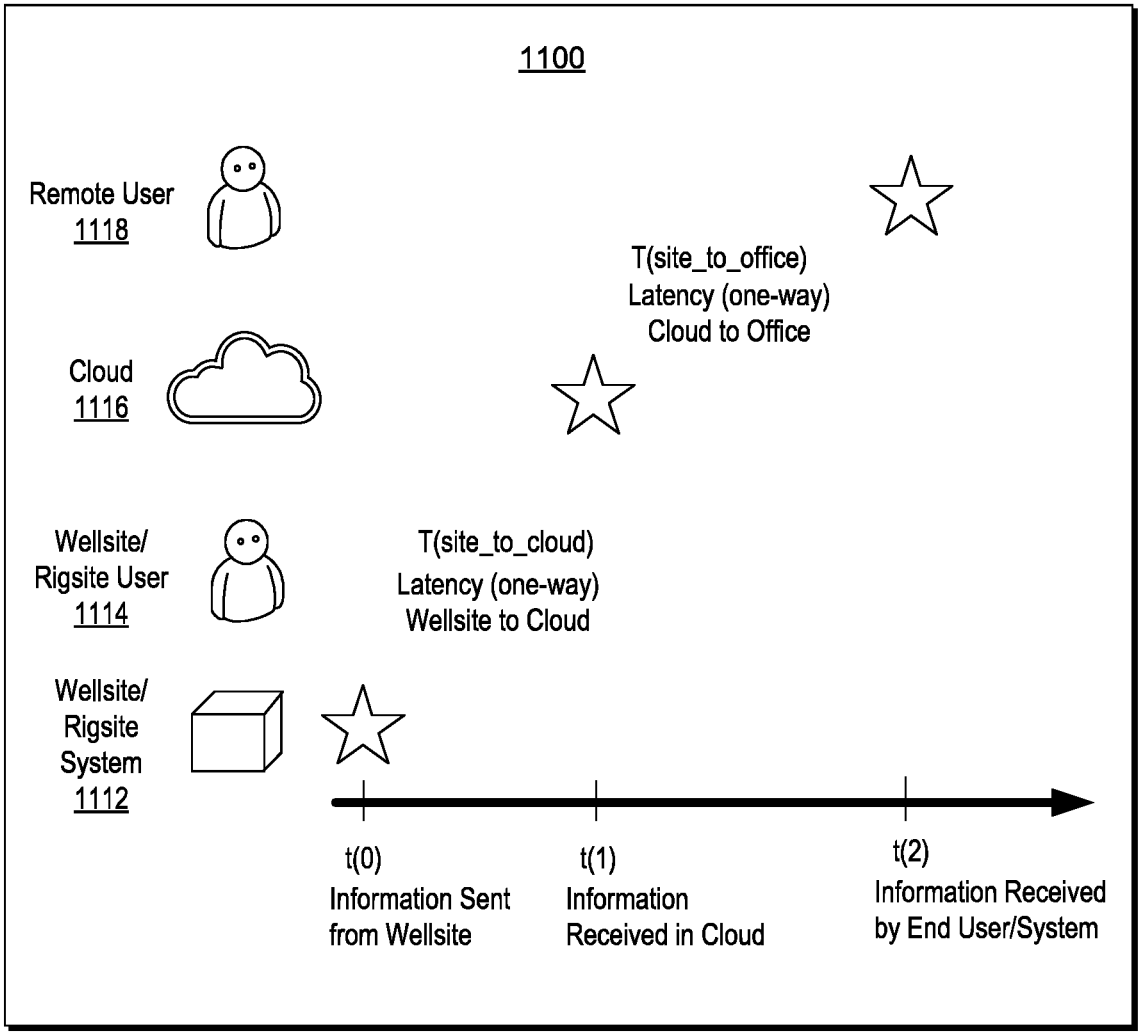
FIG. 11 illustrates an example of a timeline of events.

FIG. 11 shows an example of a timeline of events 1100 where various entities can transmit and/or receive information at one or more times. As to entities, as an example, consider a wellsite and/or rigsite system 1112, a wellsite and/or rigsite user 1114 (e.g., a local user device), a cloud infrastructure 1116 and a remote user 1118 (e.g., a remote user device). In such an example, the wellsite and/or rigsite system 1112 may be considered to be local and the remote user 1118 may be considered to be remote, physically some distance from the system 1112 and operatively coupled to the system 1112 via one or more networks.

In the example of FIG. 11, the scenario illustrated is an example of information flowing from the wellsite and/or rigsite system 1112 into the cloud infrastructure 1116 (e.g., and/or data access provider) where such information arrives at destination of the remote user 1118 (e.g., a remote user device and/or system) that can consume at least a portion of the information. In the example of FIG. 11, two hops are illustrated for which latencies can add-up. For example, when the remote user 1118 (e.g., or system) in the office receives the information, delays can include T(cloud_to_office)+T(site_to_cloud). In the example of FIG. 11, there is no compensation mechanism present that addresses the delays (e.g., latencies). In such an example, the information may be "stale" by the time it arrives at the site of the remote user 1118. As to being stale, it may not represent with certainty a current state of the wellsite and/or rigsite system 1112. Rather, it may represent a prior state of the wellsite and/or rigsite system 1112.

Figure 12:
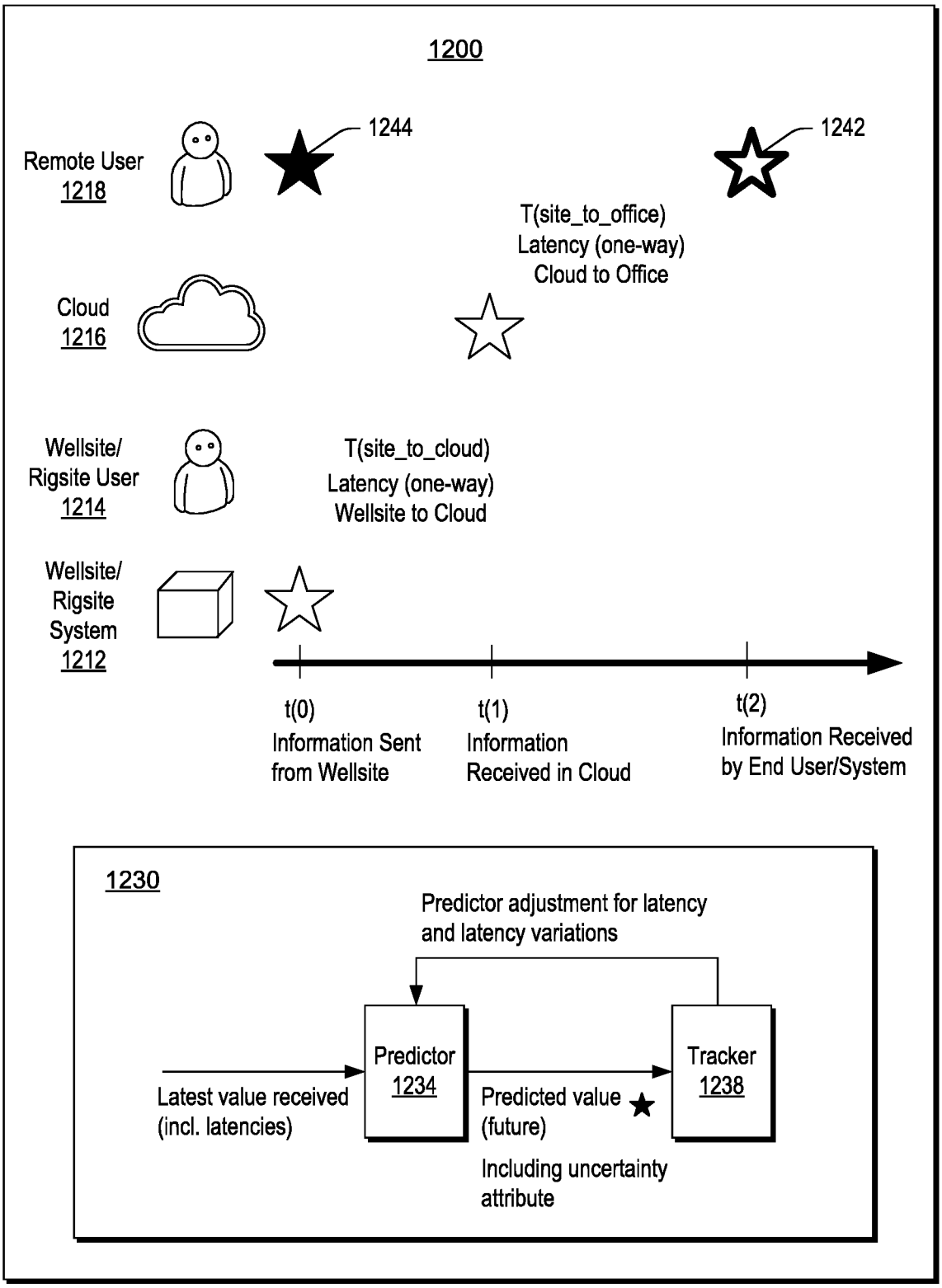
FIG. 12 illustrates an example of a timeline of events and an example of a system.

FIG. 12 shows an example of a timeline of events 1200 along with a wellsite and/or rigsite system 1212, a wellsite and/or rigsite user 1214 (e.g., a local device or system), a cloud infrastructure 1216 and a remote user 1218 (e.g., a remote device or a system).

In the example of FIG. 12, a compensation system 1230 can include a predictor 1234 and a tracker 1238. As an example, the compensation system 1230 may be utilized to implement a compensation method that compensates at least in part for one or more latencies associated with transmission of information over one or more networks. As an example, the predictor 1234 can provide for predicting a future value based at least in part on a received value and optionally based at least in part on uncertainty (e.g., one or more uncertainty attributes, etc.). In such an example, a predicted value may be accompanied by one or more uncertainty metrics as may be associated with, for example, a cone of uncertainty that enlarges with respect to time. As an example, a predicted range may be provided where a likely value may be indicated along with an upper limit and a lower limit.

As an example, the compensation system 1230 may provide for automatic compensation of one or more latencies associated with oilfield monitoring, remote control, etc. As an example, the a compensation system can provide one or more users (e.g., user devices or user systems) and/or systems along communication hops with one or more estimated values of information in real-time (e.g., without delay) as well as, for example, an estimation of inaccuracy in the one or more estimated values.

In the example of FIG. 12, a prediction/estimation process is described with respect to the compensation system 1230 and the timeline of events 1200 where, for example, the compensation system 1230 may operate remotely (e.g., cloud or in office); or, for example, additionally or alternatively, at a source of data generation (e.g., at a wellsite and/or rigsite system).

As shown in the example of FIG. 12, the predictor 1234 can receive a latest data received, which is delayed data. In such an example, the predictor 1234 can process the data to compensate for one or more latencies in a manner that can include extrapolating the data, for example, based at least in part on one or more historical trends, other understanding of the dynamic of the data/measurement being monitored, etc. As to output, the predictor 1234 may output a predicted value and, for example, optionally an error estimate.

In the example of FIG. 12, the tracker 1238 can compare the estimated value and an actual value once the actual value arrives and adjust one or more latencies and/or one or more compensation models based at least in part on an error estimated and an actual error. Such a feedback loop can help to ensure that the compensation system 1230 is adapting to possibly one or more changing conditions, for example, consider conditions related to network and/or system performance.

In the example timeline of events 1200 of FIG. 12, an "actual value" 1242 is shown at an associated received time t(2) by a remote user or system, and a predicted value 1244 is shown as associated with a time t(0) at which it was acquired and sent from the wellsite, which may be provided at a time t(2), for example, by the compensation system 1230.

Figure 13:
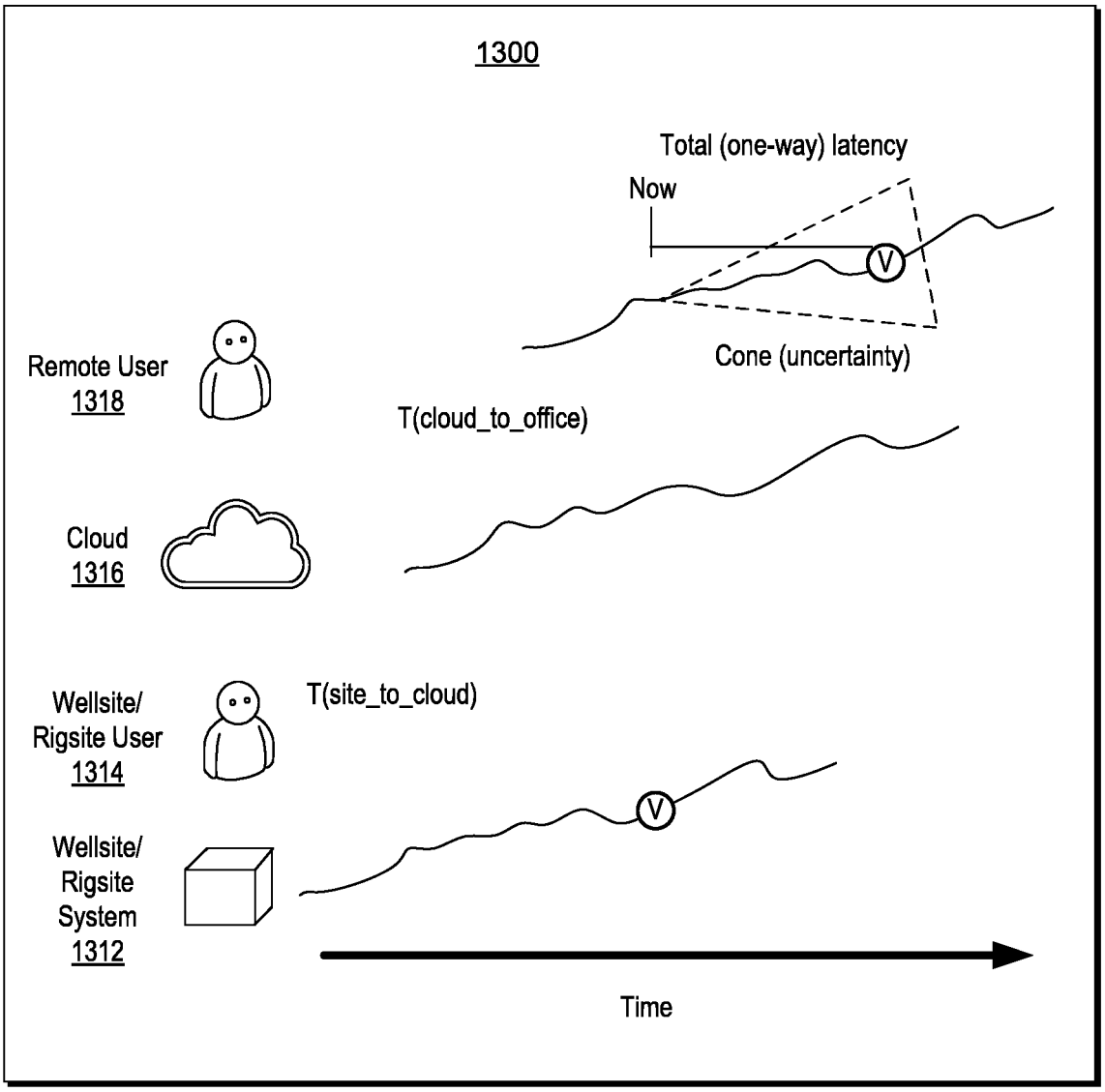
FIG. 13 illustrates an example of a timeline of events.

FIG. 13 shows an example of a timeline of events 1300 along with a wellsite and/or rigsite system 1312, a wellsite and/or rigsite user 1314 (e.g., a local user device, etc.), a cloud infrastructure 1316 and a remote user 1318 (e.g., remote device, remote system, etc.).

In the example of FIG. 13, a trending curve is illustrated which can be compensated for latencies. For example, a value acquired at t=NOW can be predicted, with a cone of uncertainty, given the known latency (e.g., measured independently via a network monitoring Quality of Service (QoS) mechanism).

In the example of FIG. 13, at time=Now, a compensation system can be used to estimate the value in the future, for example, by compensating for known latencies using prior knowledge of trending data, nature/physics and/or data analytics (e.g., capable of providing an estimation of the future value of the data).

As an example, a wireline services system server can include a processor; memory operatively coupled to the processor; a network interface; at least one wireline services equipment interface; and processor-executable instructions stored in the memory executable to instruct the wireline services system server to operate in a user interactive mode via receipt of client communications via a network connection at the network interface; operate in an automated mode; and operate in a safe mode responsive to interruption of a network connection at the network interface. In such an example, the wireline services system server can include processor-executable instructions stored in the memory executable to instruct the wireline services system server to build a model of a wireline services equipment set up at a wellsite. For example, the model can represent various pieces of equipment where information may be associated with such representations (see, e.g., the model 800 of FIG. 8). As an example, an automated mode and/or a safe mode can operate at least in part on the model (e.g., via representations of equipment, information associated therewith, physical phenomena, etc.).

As an example, an automated mode can operate to transmit information via a network connection at a network interface (e.g., of a server, etc.). In such an example, a wireline services system server can include processor-executable instructions stored in the memory executable to instruct the wireline services system server to transition from the automated mode to a safe mode responsive to interruption of the network connection at the network interface. In such an example, the network connection can be, for example, a satellite network connection and, for example, the interruption of the network connection can span a period of time greater than approximately one minute prior to the transition. For example, a time limit may be associated with a particular type of communication system (e.g., satellite, etc.) where the time limit may be set by default, based on type or types of information to be communicated, etc. As an example, a timer or other appropriate circuitry may be utilized to determine times and to issue a signal, command, etc. that an interruption has occurred, for example, to trigger a transition (e.g., or transitions).

As an example, a wireline services system server can include processor-executable instructions stored in memory executable to instruct the wireline services system server to operate an orchestration tier and an automation tier. For example, such an orchestration tier can include an application programming interface (API) for a user interactive mode where, for example, an automation tier can include an interface that receives information via the orchestration tier. As an example, for a safe mode, an automation tier can operate independent of information of an orchestration tier. As an example, for an automated mode, an orchestration tier can operate independent of information received via a network interface (e.g., where an interruption may have occurred, etc.).

As an example, a wireline services system server can include processor-executable instructions stored in memory executable to instruct the wireline services system server to operate a winch that conveys a wireline tool via a cable. For example, consider the model 800 of FIG. 8, which shows a drum (e.g., of winch equipment, etc.) as a representation of a physical drum that can be at a rigsite and operatively coupled to a cable or cables that are operatively coupled to a wireline tool or tools and where the controller 820 can interact with the winch monitor/control block to effectuate monitoring and/or control of a modeled drum and/or a physical drum. As an example, the model 800 may be operable at least in part via a domain specific language (DSL) (see, e.g., the example of FIG. 7, etc.). As an example, a wireline services system server may be operable via execution, interpretation, etc. of one or more instructions in a domain specific language (DSL), for example, consider such a server where operation of a winch is according to logic specified in a domain specific language (DSL) (see, e.g., the logic 860 of FIG. 8). As an example, a wireline services system server may provide for operation of a winch based at least in part on depth information (see, e.g., the depth acquisition block and/or the depth and tension block of the model 800 of FIG. 8). As an example, a wireline services system server may provide for operation of a winch based at least in part on a speed limit for conveyance (see, e.g., the cable speed block and/or the acceleration/speed block of the model 800 of FIG. 8).

As an example, a method can include enabling operational modes of a wireline services system operatively coupled to wireline services equipment at a wellsite where the operational modes include a user interactive mode and an automated mode; receiving a communication via a network connection at a network interface of the wireline services system at the wellsite; operating the wireline services system equipment based at least in part on the communication; and transitioning the wireline services system to the automated mode. In such an example, the operational modes can include a safe mode where such a method can include detecting interruption of the network connection at the network interface and transitioning the wireline services system to the safe mode. As an example, an automated mode can operate a wireline services system according to a model of at least a portion of the wireline services equipment at the wellsite (see, e.g., the model 800 of FIG. 8).

As an example, one or more computer-readable storage media can include computer-executable instructions executable to instruct a computer to: enable operational modes of a wireline services system operatively coupled to wireline services equipment at a wellsite where the operational modes include a user interactive mode and an automated mode; receive a communication via a network connection at a network interface of the wireline services system at the wellsite; operate the wireline services system equipment based at least in part on the communication; and transition the wireline services system to the automated mode. In such an example, the operational modes can include a safe mode where, for example, instructions include instructions to detect interruption of the network connection at the network interface and to transition the wireline services system to the safe mode.

According to an embodiment, one or more computer-readable media may include computer-executable instructions to instruct a computing system to output information for controlling a process. For example, such instructions may provide for output to sensing process, an injection process, drilling process, an extraction process, an extrusion process, a pumping process, a heating process, etc.

Figure 14:
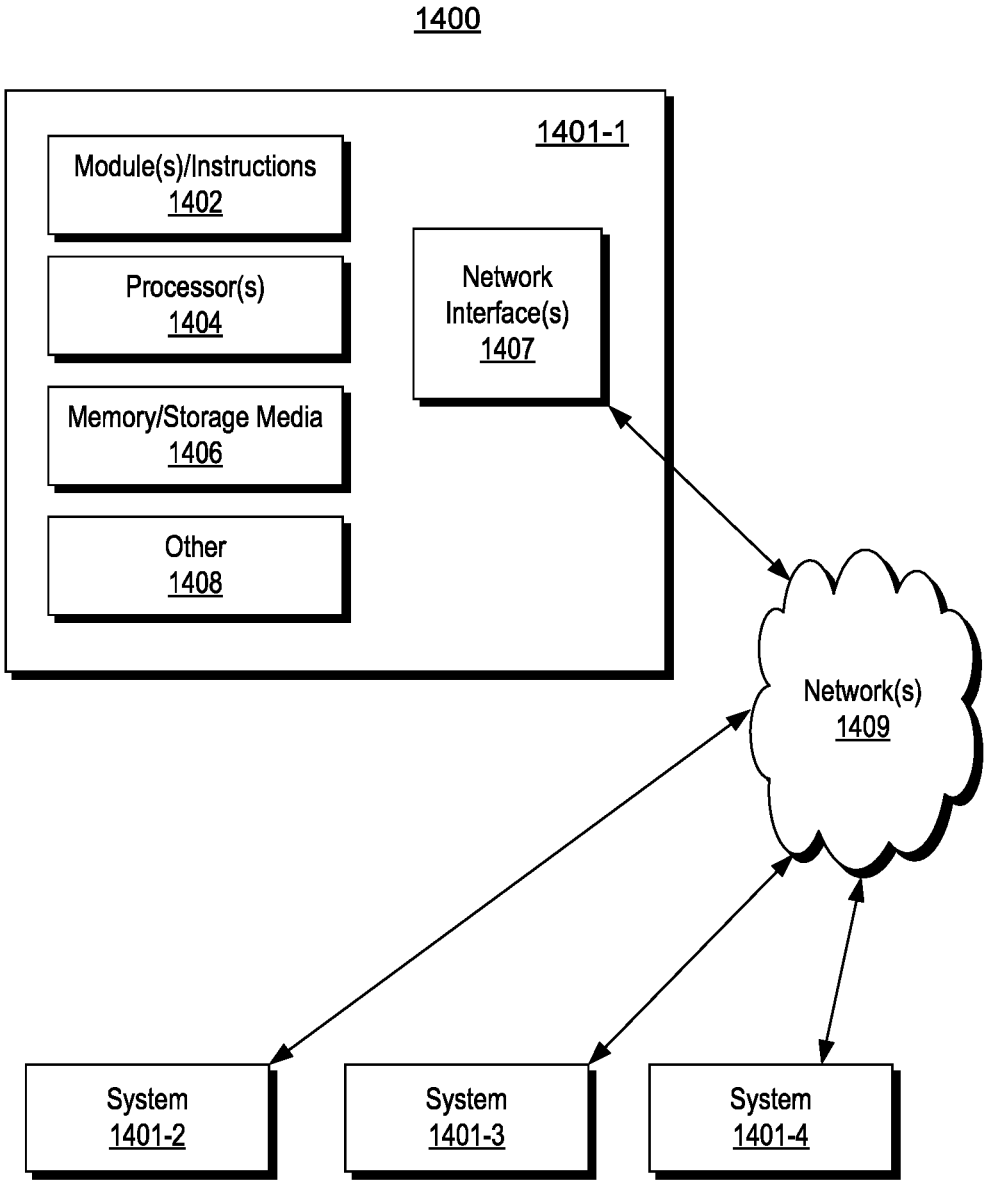
FIG. 14 illustrates an example of a system.

In some embodiments, a method or methods may be executed by a computing system. FIG. 14 shows an example of a system 1400 that can include one or more computing systems 1401-1, 1401-2, 1401-3 and 1401-4, which may be operatively coupled via one or more networks 1409, which may include wired and/or wireless networks.

As an example, a system can include an individual computer system or an arrangement of distributed computer systems. In the example of FIG. 14, the computer system 1401-1 can include one or more modules 1402, which may be or include processor-executable instructions, for example, executable to perform various tasks (e.g., receiving information, requesting information, processing information, simulation, outputting information, etc.).

As an example, a module may be executed independently, or in coordination with, one or more processors 1404, which is (or are) operatively coupled to one or more storage media 1406 (e.g., via wire, wirelessly, etc.). As an example, one or more of the one or more processors 1404 can be operatively coupled to at least one of one or more network interface 1407. In such an example, the computer system 1401-1 can transmit and/or receive information, for example, via the one or more networks 1409 (e.g., consider one or more of the Internet, a private network, a cellular network, a satellite network, etc.).

As an example, the computer system 1401-1 may receive from and/or transmit information to one or more other devices, which may be or include, for example, one or more of the computer systems 1401-2, etc. A device may be located in a physical location that differs from that of the computer system 1401-1. As an example, a location may be, for example, a processing facility location, a data center location (e.g., server farm, etc.), a rig location, a wellsite location, a downhole location, etc.

As an example, a processor may be or include a microprocessor, microcontroller, processor module or subsystem, programmable integrated circuit, programmable gate array, or another control or computing device.

As an example, the storage media 1406 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY® disks, or other types of optical storage, or other types of storage devices.

As an example, a storage medium or media may be located in a machine running machine-readable instructions, or located at a remote site from which machine-readable instructions may be downloaded over a network for execution.

As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include a general purpose processors or application specific chips (e.g., or chipsets), such as ASICs, FPGAs, PLDs, or other appropriate devices.

Figure 15:
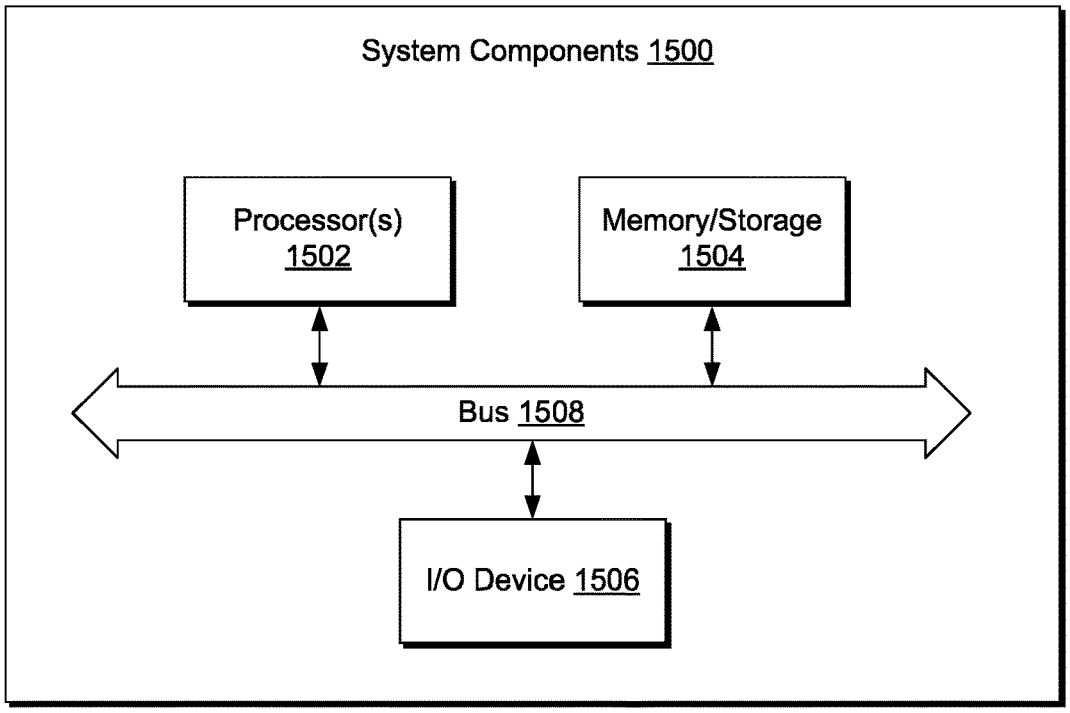
FIG. 15 illustrates example components of a system and a networked system.
Figure 15:
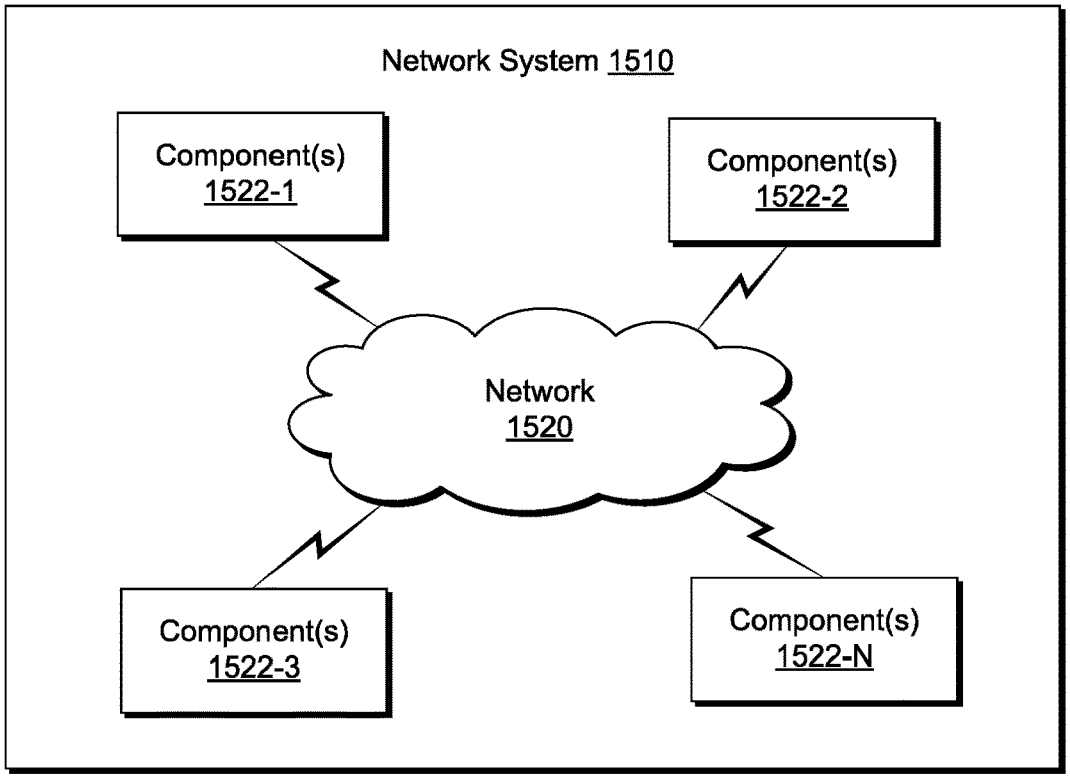

FIG. 15 shows components of a computing system 1500 and a networked system 1510. The system 1500 includes one or more processors 1502, memory and/or storage components 1504, one or more input and/or output devices 1506 and a bus 1508. According to an embodiment, instructions may be stored in one or more computer-readable media (e.g., memory/storage components 1504). Such instructions may be read by one or more processors (e.g., the processor(s) 1502) via a communication bus (e.g., the bus 1508), which may be wired or wireless. The one or more processors may execute such instructions to implement (wholly or in part) one or more attributes (e.g., as part of a method). A user may view output from and interact with a process via an I/O device (e.g., the device 1506). According to an embodiment, a computer-readable medium may be a storage component such as a physical memory storage device, for example, a chip, a chip on a package, a memory card, etc.

According to an embodiment, components may be distributed, such as in the network system 1510. The network system 1510 includes components 1522-1, 1522-2, 1522-3, . . . 1522-N. For example, the components 1522-1 may include the processor(s) 1502 while the component(s) 1522-3 may include memory accessible by the processor(s) 1502. Further, the component(s) 1522-2 may include an I/O device for display and optionally interaction with a method. The network may be or include the Internet, an intranet, a cellular network, a satellite network, etc.

As an example, a device may be a mobile device that includes one or more network interfaces for communication of information. For example, a mobile device may include a wireless network interface (e.g., operable via IEEE 802.11, ETSI GSM, BLUETOOTH®, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A wireline services system server comprising:

a processor;

memory operatively coupled to the processor;

a network interface;

at least one wireline services equipment interface; and processor-executable instructions stored in the memory executable to instruct the wireline services system server to operate in a user interactive mode via receipt of communications via a network connection at the network interface;

operate in an automated mode according to a model of a wireline services equipment set up at a wellsite; and operate in a safe mode responsive to an analysis of latency of a network connection in relationship to a wireline tool conveyance speed of the wireline services equipment set up at the wellsite, wherein the safe mode is an operational mode for operation of the wireline services equipment set up at the wellsite.

2. The wireline services system server of claim 1 comprising processor-executable instructions stored in the memory executable to instruct the wireline services system server to build the model of the wireline services equipment set up.

3. The wireline services system server of claim 1 wherein the safe mode operates based at least in part on the model.

4. The wireline services system server of claim 1 wherein the automated mode operates to transmit information via a network connection at the network interface.

5. The wireline services system server of claim 4 wherein the processor-executable instructions comprise processor-executable instructions to instruct the wireline services system server to transition from the automated mode to the safe mode responsive to interruption of the network connection at the network interface.

6. The wireline services system server of claim 5 wherein the network connection comprises a satellite network connection and wherein the interruption of the network connection spans a period of time greater than approximately one minute prior to the transition.

7. The wireline services system server of claim 1 wherein the processor-executable instructions comprise processor-executable instructions to instruct the wireline services system server to operate an orchestration tier and an automation tier.

8. The wireline services system server of claim 7 wherein the orchestration tier comprises an application programming interface (API) for the user interactive mode and wherein the automation tier comprises an interface that receives information via the orchestration tier.

9. The wireline services system server of claim 7 wherein, for the safe mode, the automation tier operates independent of information of the orchestration tier.

10. The wireline services system server of claim 7 wherein, for the automated mode, the orchestration tier operates independent of information received via the network interface.

11. The wireline services system server of claim 1 comprising processor-executable instructions stored in the memory executable to instruct the wireline services system server to operate a winch that conveys a wireline tool via a cable.

12. The wireline services system server of claim 11 wherein operation of the winch is according to logic specified in a domain specific language (DSL).

13. The wireline services system server of claim 11 wherein operation of the winch is based at least in part on depth information.

14. The wireline services system server of claim 11 wherein operation of the winch is based at least in part on a speed limit for conveyance.

15. The wireline services system server of claim 1, wherein the analysis of latency comprises prediction of a depth compensated for latency wherein the depth is a future prediction with a quantifiable amount of uncertainty based at least in part on the wireline tool conveyance speed.

16. The wireline services system server of claim 1, wherein the analysis of latency comprises analysis of a latency trend.

17. A method comprising:

enabling operational modes of a wireline services system operatively coupled to wireline services equipment at a wellsite wherein the operational modes comprise a safe mode and an automated mode, wherein the automated mode operates according to a model of a wireline services equipment set up at a wellsite;

receiving at least one communication via a network connection at a network interface of the wireline services system at the wellsite;

analyzing latency of the network connection in relationship to a wireline tool conveyance speed of the wirelines services equipment set up at the wellsite; and transitioning the wireline services system from the automated mode to the safe mode based on the analyzing, wherein, in the safe mode, the wireline services system operates the wireline services equipment set up at the wellsite.

18. The method of claim 17 comprising detecting interruption of the network connection at the network interface and transitioning the wireline services system from the automated mode to the safe mode.

19. One or more computer-readable storage media comprising computer-executable instructions executable to instruct a computer to:

enable operational modes of a wireline services system operatively coupled to wireline services equipment at a wellsite wherein the operational modes comprise a safe mode and an automated mode, wherein the automated mode operates according to a model of a wireline services equipment set up at a wellsite;

receive at least one communication via a network connection at a network interface of the wireline services system at the wellsite;

analyze latency of the network connection in relationship to a wireline tool conveyance speed of the wirelines services equipment set up at the wellsite; and transition the wireline services system from the automated mode to the safe mode based on the analyzing, wherein, in the safe mode, the wireline services system operates the wireline services equipment set up at the wellsite.

20. The one or more computer-readable storage media of claim 19 wherein the operational modes comprise a safe mode and wherein the instructions comprise instructions to detect interruption of the network connection at the network interface and to transition the wireline services system from the automated mode to the safe mode.

* * * * *